US009596718B2

(12) United States Patent
Nakayama

(10) Patent No.: US 9,596,718 B2
(45) Date of Patent: Mar. 14, 2017

(54) HEATER AND IMAGE HEATING APPARATUS INCLUDING THE SAME

(71) Applicant: CANON KABUSHIKI KAISHA, Tokyo (JP)

(72) Inventor: Toshinori Nakayama, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/719,474

(22) Filed: May 22, 2015

(65) Prior Publication Data

US 2015/0341986 A1 Nov. 26, 2015

(30) Foreign Application Priority Data

May 26, 2014 (JP) ..... 2014-108592

(51) Int. Cl.
*G03G 15/20* (2006.01)
*H05B 3/00* (2006.01)
(Continued)

(52) U.S. Cl.
CPC ..... *H05B 3/0014* (2013.01); *G03G 15/2042* (2013.01); *G03G 15/2053* (2013.01);
(Continued)

(58) Field of Classification Search
CPC ..... G03G 15/2042; G03G 15/2053; G03G 2215/2035; G03G 2215/2006; H05B 3/0014; H05B 3/06; H05B 3/03
(Continued)

(56) References Cited

U.S. PATENT DOCUMENTS 5,376,773 A 12/1994 Masuda et al.
6,084,208 A 7/2000 Okuda et al.
(Continued)

FOREIGN PATENT DOCUMENTS

JP 6-250539 A 9/1994
JP 2012037613 A 2/2012

OTHER PUBLICATIONS

Machine translation of JP 2012-037613 (with publication date of Feb. 23, 2012) printed on Mar. 9, 2016.*
(Continued)

*Primary Examiner* — Sophia S Chen
(74) *Attorney, Agent, or Firm* — Fitzpatrick, Cella, Harper & Scinto

(57) ABSTRACT

A heater usable with an image heating apparatus includes contacts including at least one first contact provided on a substrate and connectable with a first terminal, and second contacts provided on the substrate and connectable with a second terminal; electrodes arranged in a longitudinal direction of the substrate with predetermined gaps; electroconductive lines connecting the electrodes with respective ones of the contacts such that the electrode connected with the first contact and the electrode connected with the second contacts are alternately arranged in the longitudinal direction of the substrate; and heat generating portions, provided between adjacent electrodes, respectively, for generating heat by electric power supply between adjacent electrodes, wherein all of the first contacts are provided in one end portion of the substrate with respect to the longitudinal direction, and all of the second contacts are provided in the other end portion with respect to the longitudinal direction.

16 Claims, 15 Drawing Sheets

(51) Int. Cl.
*H05B 3/03* (2006.01)
*H05B 3/06* (2006.01)

(52) U.S. Cl.
CPC ..... *H05B 3/03* (2013.01); *H05B 3/06* (2013.01); *G03G 2215/2035* (2013.01)

(58) Field of Classification Search
USPC ..... 399/334, 328, 329, 330; 219/216
See application file for complete search history.

(56) References Cited

U.S. PATENT DOCUMENTS 6,456,819 B1 9/2002 Abe et al.
7,203,438 B2 * 4/2007 Omata ..... G03G 15/2042 399/334
7,260,351 B2 8/2007 Nakayama
7,263,303 B2 8/2007 Nakayama
7,343,130 B2 3/2008 Nakayama
7,430,392 B2 9/2008 Ito et al.
7,460,821 B2 12/2008 Ai et al.
7,505,724 B2 3/2009 Nakayama
7,590,366 B2 9/2009 Nakayama
7,729,628 B2 6/2010 Nakayama
7,907,861 B2 3/2011 Nakayama
8,145,086 B2 3/2012 Chiyoda et al.
8,306,446 B2 11/2012 Ito et al.
8,559,837 B2 10/2013 Nakayama
8,712,271 B2 4/2014 Nakayama et al.
8,750,739 B2 6/2014 Tamaki et al.
2007/0193996 A1 * 8/2007 Nakajima ..... H05B 3/26 219/209
2007/0237536 A1 * 10/2007 Roof ..... G03G 15/2042 399/334 X
2012/0121306 A1 5/2012 Shimura et al.
2012/0201581 A1 8/2012 Shimura
2012/0201582 A1 8/2012 Shimura et al.
2012/0224876 A1 9/2012 Nakayama et al.
2013/0299480 A1 11/2013 Kakubari et al.
2013/0322897 A1 12/2013 Yago et al.
2015/0037052 A1 * 2/2015 Muramatsu ..... G03G 15/2042 399/334 X

OTHER PUBLICATIONS

U.S. Appl. No. 14/718,557, filed May 21, 2015.
U.S. Appl. No. 14/718,672, filed May 21, 2015.
U.S. Appl. No. 14/719,497, filed May 22, 2015.
U.S. Appl. No. 14/794,869, filed Jul. 9, 2015.
U.S. Appl. No. 14/799,056, filed Jul. 14, 2015.
European Search Report issued in counterpart European Patent Application No. 15168844.7, dated Nov. 3, 2015.
Office Action in Russian Patent Application No. 2015119674, mailed Aug. 24, 2016.
Russian Decision to Grant issued in corresponding Russian Application No. 2015/119674/28(030470) dated Jan. 21, 2017.

* cited by examiner

HEATER AND IMAGE HEATING APPARATUS INCLUDING THE SAME

FIELD OF THE INVENTION AND RELATED ART

An image forming apparatus is known in which a toner image is formed on the sheet and is fixed on the sheet by heat and pressure in a fixing device. As for such a fixing device, a type of fixing device is proposed (Japanese Laid-open Patent Application Hei 6-250539) in which a heat generating element (heater) is contacted to an inner surface of a thin flexible belt to apply heat to the belt. Such a fixing device is advantageous in that the structure has a low thermal capacity, and therefore, the temperature rise to the fixing operation allowable is quick.

The heater disclosed in Japanese Laid-open Patent Application Hei 6-250539 comprises a plurality of electrodes arranged in the longitudinal direction of the substrate to connect with the heat generating element extending in the longitudinal direction of the substrate. The electrodes having different polarities are alternately arranged so that the electric currents flow through the heat generating element between the adjacent electrodes. More particularly, the electrode having one of the polarities is connected with an electroconductive line provided in one end portion side of the substrate beyond the heat generating element with respect to the widthwise direction, and the electrode having the other of the polarities is connected with an electroconductive line provided in another end portion side of the substrate beyond the heat generating element with respect to the widthwise direction. Therefore, when a voltage is applied between the electroconductive lines, the heat generating element generates heat in the entire longitudinal area.

However, the fixing device disclosed in Japanese Laid-open Patent Application Hei 6-250539 involves a point to be improved with respect to a heat generation non-uniformity of the heat generating element. As described above, in the fixing device the voltage is applied between the electroconductive lines from one end portion side of the heater with respect to the longitudinal direction. The electroconductive lines, however, have certain resistances, and therefore, the voltage applied between the electroconductive lines decreases toward the other end portion side of the substrate. Therefore, the amount of heat generation is lower in the other end portion side than in the one end portion side of the heat generating element. When the heater is used in a fixing device, the image fixed thereby involves an image defect such as gloss unevenness. It is desired, therefore, to provide a heater with which the production of the heat generation non-uniformity can be suppressed.

SUMMARY OF THE INVENTION

It is an object of the present invention to provide a heater with which the production of the heat generation non-uniformity is suppressed.

It is another object of the present invention to provide an image heating apparatus with which the production of the heat generation non-uniformity is suppressed.

According to an aspect of the present invention, there is provided a heater usable with an image heating apparatus including an electric energy supplying portion provided with a first terminal and a second terminal, and an endless belt for heating an image on a sheet, wherein said heater is contactable to the belt to heat the belt, said heater comprising a substrate; a plurality of contact portions including at least one first contact portion provided on said substrate and electrically connectable with a first terminal, and a plurality of second contact portions provided on said substrate and electrically connectable with a second terminal; a plurality of electrode portions arranged in a longitudinal direction of said substrate with predetermined gaps; a plurality of electroconductive line portions electrically connecting said electrode portions with respective ones of said contact portions such that said electrode portion electrically connected with said first contact portion and said electrode portion electrically connected with said second contact portions are alternately arranged in the longitudinal direction of said substrate; and a plurality of heat generating portions, provided between adjacent electrode portions, respectively, for generating heat by electric power supply between adjacent electrode portions, wherein all of said first contact portions are provided in one end portion side of said substrate with respect to the longitudinal direction, and all of said second contact portions are provided in the other end portion side of said substrate with respect to the longitudinal direction.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called printer.

Embodiment 1

Image Forming Apparatus

Figure 1:
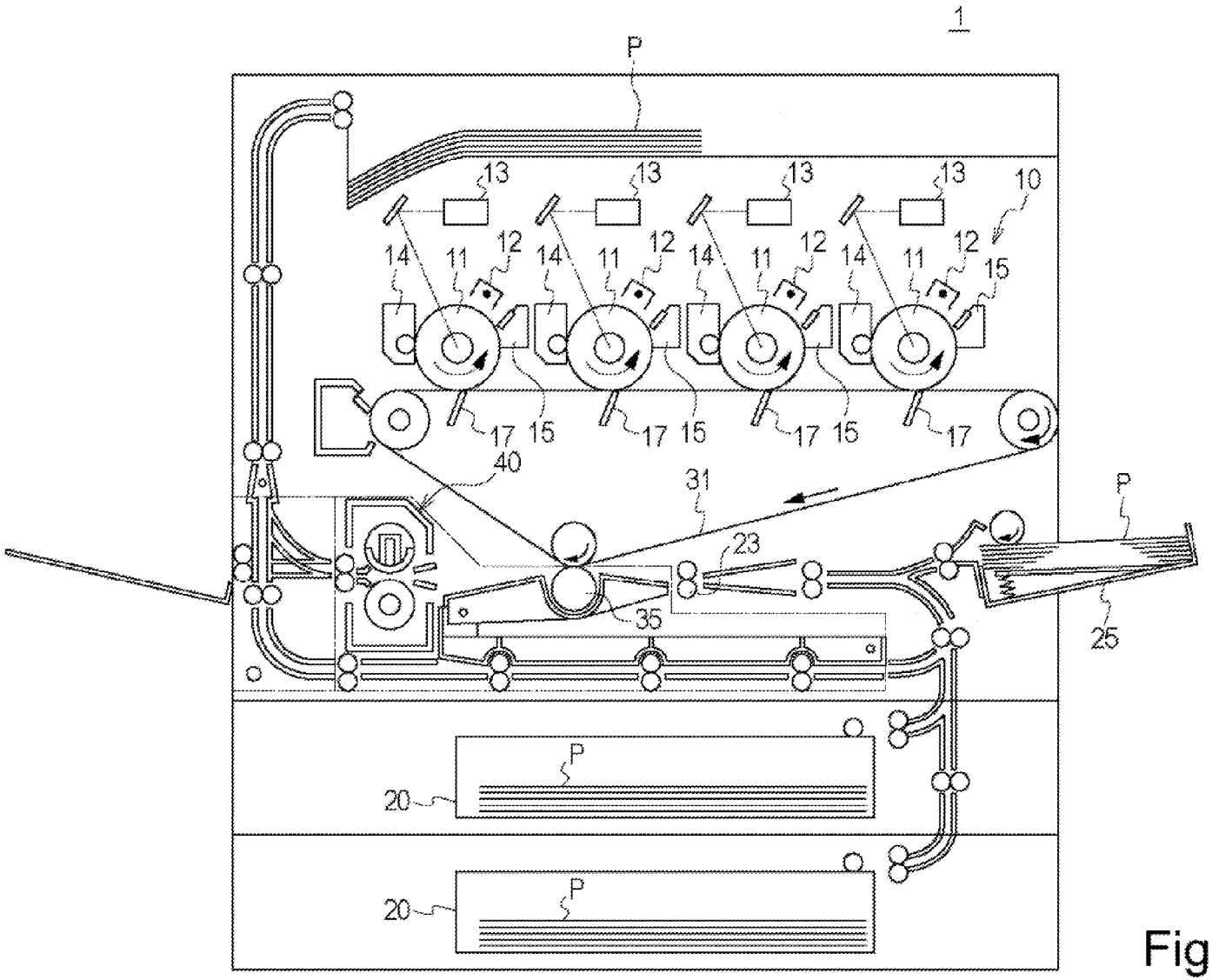
FIG. 1 is a sectional view of the image forming apparatus according to Embodiment 1 of the present invention.

FIG. 1 is a sectional view of the printer 1 which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on the sheet P. Referring to FIG. 1, the structures of the apparatus will be described in detail.

As shown in FIG. 1, the printer 1 includes image forming stations 10 for forming respective color toner images Y (yellow),), M (magenta),), C (cyan) and), Bk (black)). The image forming stations 10 include respective photosensitive drums 11 (11Y, 11M, 11C, 11Bk) corresponding to Y, M, C, Bk colors, which are arranged in the order named from the left side. Around each drum 11, similar elements are provided as follows:

a charger 12 (12Y, 12M, 12C, 12Bk); an exposure device 13 (13Y, 13M, 13C, 13Bk); a developing device 14 (14Y, 14M, 14C, 14Bk); a primary transfer blade 17 (17Y, 17M, 17C, 17Bk); and a cleaner 15 (15Y, 15M, 15C, 15Bk). The structure for the Bk toner image formation will be described as a representative, and the descriptions for the other colors are omitted for simplicity by assigning the like reference numerals. So, the elements will be simply called photosensitive drum 11, charger 12, exposure device 13, developing device 14, primary transfer blade 17, and cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17, and the cleaner 15 are provided in the order named.

A surface of the photosensitive drum 11 is electrically charged by the charger 12. Thereafter, the surface of the photosensitive drum 11 is exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation.

On the other hand, the sheet P contained in a feeding cassette 20 is placed on a multi-feeding tray 25, and is picked up by a feeding mechanism (unshown) and fed to a pair of registration rollers. The sheet P is a member on which the image is formed. Specific examples of the sheet P is plain paper, thick sheet, resin material sheet, overhead projector film, or the like. The pair of registration rollers 23 stops the sheet P at the correct oblique feeding position. The registration rollers 23 then feed the sheet P between the intermediary transfer belt 31 and the secondary transfer roller 35 in timed relation with the toner image on the intermediary transfer belt 31. The roller 35 functions to transfer the color toner images from the belt 31 onto the sheet P. Thereafter, the sheet P is fed into the fixing device (image heating apparatus) 40. The fixing device 40 applies heat and pressure to the toner image T on the sheet P to fix the toner image on the sheet P.

[Fixing Device]

Figure 2:
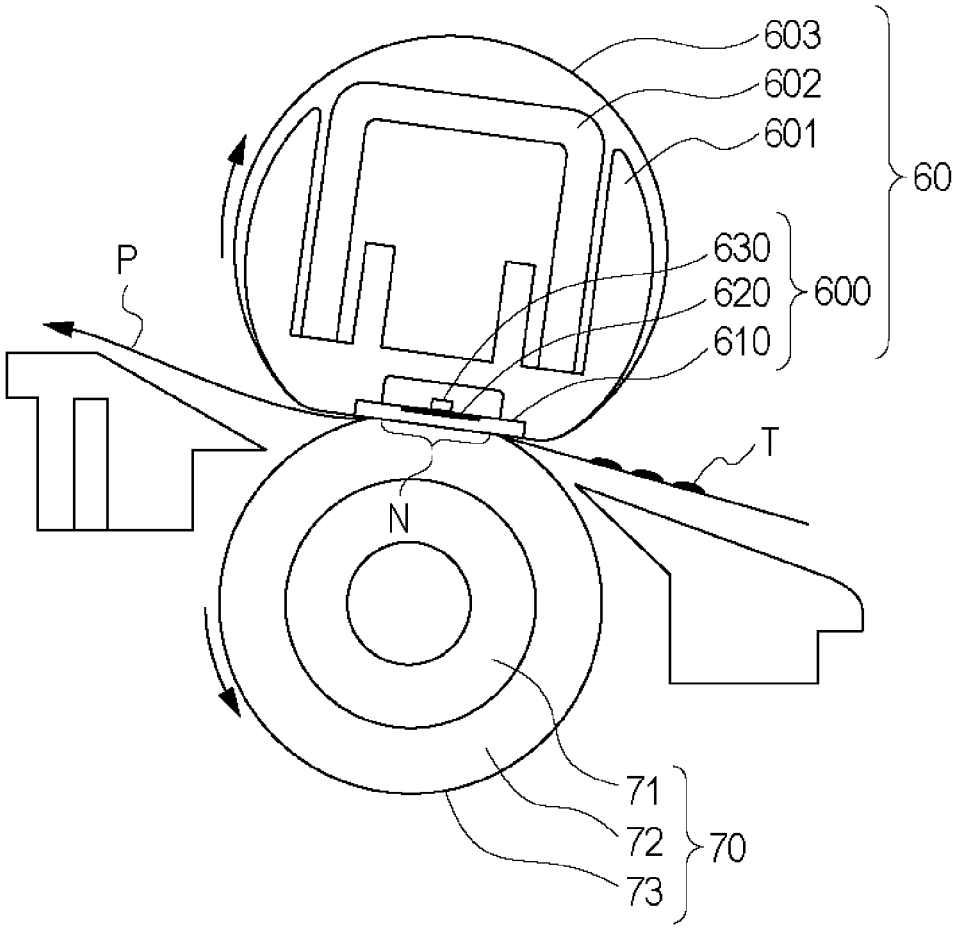
FIG. 2 is a sectional view of an image heating apparatus according to Embodiment 1 of the present invention.
Figure 3:
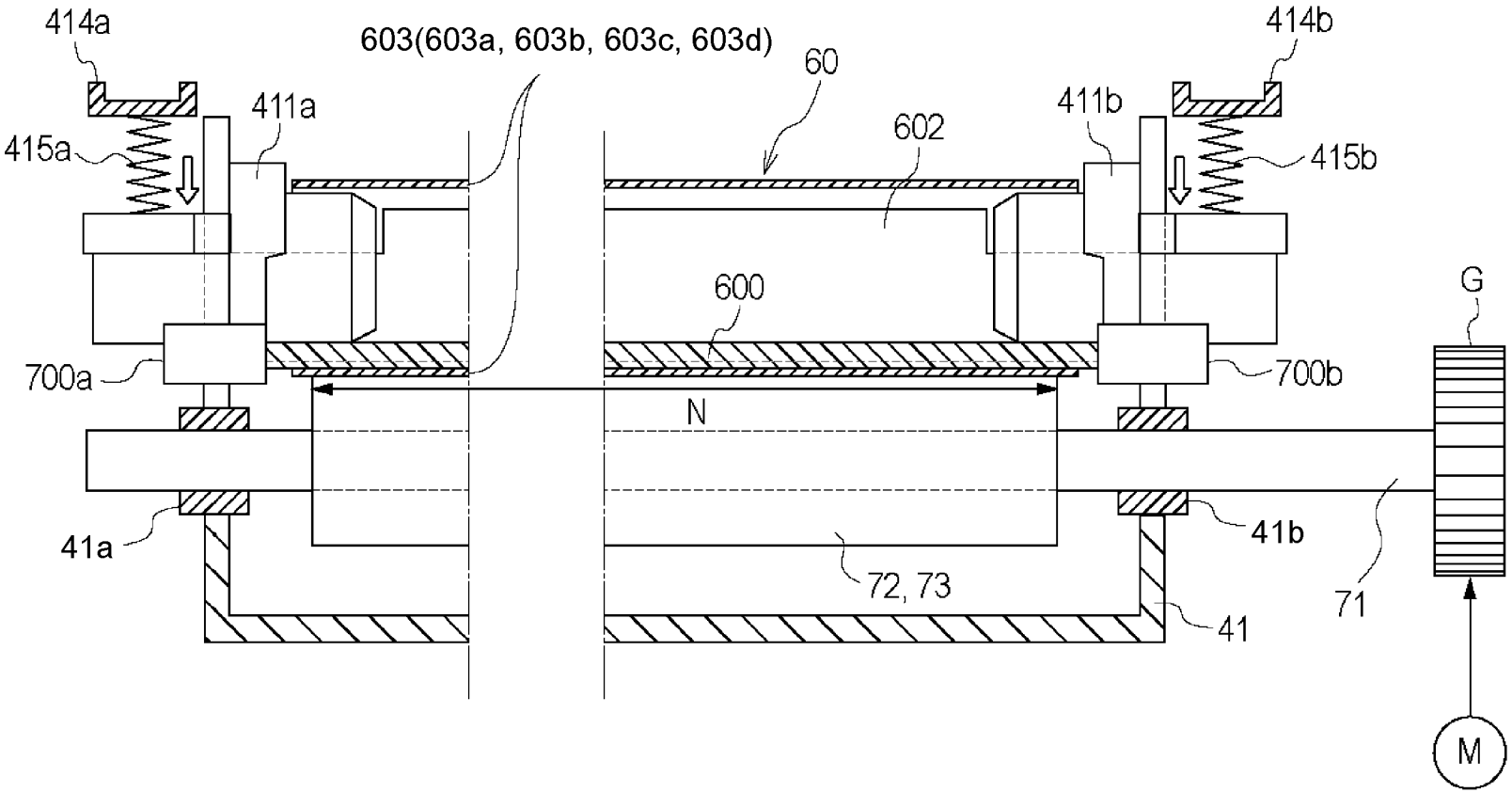
FIG. 3 is a front view of an image heating apparatus according to Embodiment 1 of the present invention.
Figure 5:
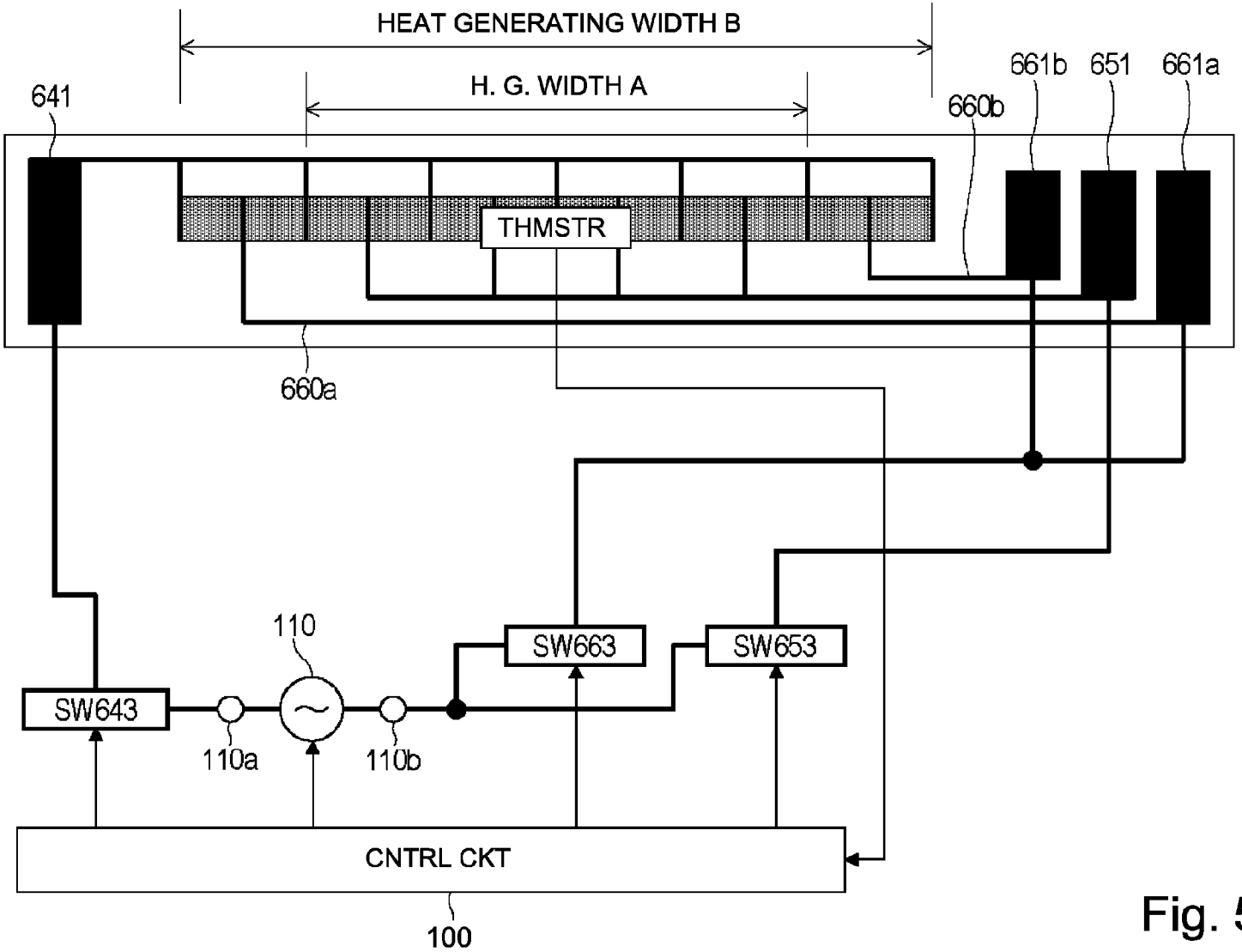
FIG. 5 illustrates the structural relationship of the image heating apparatus according to Embodiment 1 of the present invention.

The fixing device 40 which is the image heating apparatus used in the printer 1 will be described. FIG. 2 is a sectional view of the fixing device 40. FIG. 3 is a front view of the fixing device 40. FIG. 5 illustrates a structural relationship of the fixing device 40.

The fixing device 40 is an image heating apparatus for heating the image on the sheet by a heater unit 60 (unit 60). The unit 60 includes a flexible thin fixing belt 603 and a heater 600 contacted to the inner surface of the belt 603 to heat the belt 603 (low thermal capacity structure). Therefore, the belt 603 can be efficiently heated, so that quick temperature rise at the start of the fixing operation is accomplished. As shown in FIG. 2, the belt 603 is nipped between the heater 600 and the pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) to nip and feed the sheet P supplied to the nip N. At this time, the heat from the heater 600 is supplied to the sheet P through the belt 603, and therefore, the toner image T on the sheet P is heated and pressed by the nip N, so that the toner image is fixed on the sheet P by the heat and pressure. The sheet P having passed through the fixing nip N is separated from the belt 603 and is discharged. In this embodiment, the fixing process is carried out as described above. The structure of the fixing device 40 will be described in detail.

Unit 60 is a unit for heating and pressing an image on the sheet P. A longitudinal direction of the unit 60 is parallel with the longitudinal direction of the roller 70. The unit 60 comprises a heater 600, a heater holder 601, a support stay 602 and a belt 603.

The heater 600 is a heating member for heating the belt 603, slidably contacting with the inner surface of the belt 603. The heater 600 is pressed to the inside surface of the belt 603 toward the roller 70 so as to provide a desired nip width of the nip N. The dimensions of the heater 600 in this embodiment are 5-20 mm in width (the dimension as measured in the left-right direction in FIG. 2), 350-400 mm in length (the dimension measured in the front-rear direction in FIG. 2), and 0.5-2 mm in thickness. The heater 600 comprises a substrate 610 elongated in a direction perpendicular to the feeding direction of the sheet P (widthwise direction of the sheet P), and a heat generating resistor 620 (heat generating element 620).

The heater 600 is fixed on the lower surface of the heater holder 601 along the longitudinal direction of the heater holder 601. In this embodiment, the heat generating element 620 is provided on the back side of the substrate 610 which is not in slidable contact with the belt 603, but the heat generating element 620 may be provided on the front surface of the substrate 610 which is in slidable contact with the belt 603. However, the heat generating element 620 is preferably provided on the back side of the substrate 610 by which uniform heating of the substrate 610 is accomplished, from the standpoint of preventing non-uniform heat application which may be caused by a non-heat generating portion of the heat generating element 620. The details of the heater 600 will be described hereinafter.

The belt 603 is a cylindrical (endless) belt (film) for heating the image on the sheet in the nip N. The belt 603 comprises a base material 603*a*, an elastic layer 603*b* thereon, and a parting layer 603*c* on the elastic layer 603*b*, for example. The base material 603*a* may be made of metal material such as stainless steel or nickel, or a heat resistive resin material such as polyimide. The elastic layer 603*b* may be made of an elastic and heat resistive material such as a silicone rubber or a fluorine-containing rubber. The parting layer 603*c* may be made of fluorinated resin material or silicone resin material.

The belt 603 of this embodiment has dimensions of approx. 30 mm in outer diameter, approx. 330 mm in length (the dimension measured in the front-rear direction in FIG. 2), approx. 30 μm in thickness, and the material of the base material 603*a* is nickel. The silicone rubber elastic layer 603*b* having a thickness of approx. 400 μm is formed on the base material 603*a*, and a fluorine resin tube (parting layer 603*c*) having a thickness of approx. 20 μm coats the elastic layer 603*b*.

The belt contacting surface of the substrate 610 may be provided with a polyimide layer having a thickness of approx. 10 μm as a sliding layer 603*d*. When the polyimide layer is provided, the rubbing resistance between the fixing belt 603 and the heater 600 is low, and therefore, the wearing of the inner surface of the belt 603 can be suppressed. In order to further enhance the slidability, a lubricant such as grease may be applied to the inner surface of the belt.

The heater holder 601 (holder 601) functions to hold the heater 600 in the state of urging the heater 600 toward the inner surface of the belt 603. The holder 601 has a semi-arcuate cross-section (the surface shown in FIG. 2) and functions to regulate a rotation orbit of the belt 603. The holder 601 may be made of heat resistive resin material or the like. In this embodiment, it is Zenite 7755™ available from Dupont.

The support stay 602 supports the heater 600 by way of the holder 601. The support stay 602 is preferably made of a material which is not easily deformed even when a high pressure is applied thereto, and in this embodiment, it is made of SUS304 (stainless steel).

As shown in FIG. 3, the support stay 602 is supported by left and right flanges 411*a* and 411*b* at the opposite end portions with respect to the longitudinal direction. The flanges 411*a* and 411*b* may be simply called flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between a flange 411*b* and a pressing arm 414*b*, an urging spring 415*b* is compressed. The urging springs 415*a* and 415*b* may be simply called urging spring 415. With such a structure, an elastic force of the urging spring 415 is applied to the heater 600 through the flange 411 and the support stay 602. The belt 603 is pressed against the upper surface of the roller 70 at a predetermined urging force to form the nip N having a predetermined nip width. In this embodiment, the pressure is approx. 156.8 N at one end portion side and approx. 313.6 N (32 kgf) in total.

As shown in FIG. 3, a connector 700 is provided as an electric energy supply member electrically connected with the heater 600 to supply the electric power to the heater 600. The connectors 700*a*, 700*b* may be simply called the connector 700. The connector 700 is detachably provided at one longitudinal end portion of the heater 600. The connector 700 is detachably provided at the other longitudinal end portion of the heater 600. The connector 700 is easily detachably mounted to the heater 600, and therefore, assembling of the fixing device 40 and the exchange of the heater 600 or belt 603 upon damage of the heater 600 is easy, thus providing good maintenance property. Details of the connector 700 will be described hereinafter.

As shown in FIG. 2, the roller 70 is a nip forming member which contacts an outer surface of the belt 603 to cooperate with the belt 603 to form the nip N. The roller 70 has a multi-layer structure on the core 71 made of metal material, the multi-layer structure including an elastic layer 72 on the metal core 71 and a parting layer 73 on the elastic layer 72. Examples of the materials of the metal core 71 include SUS (stainless steel), SUM (sulfur and sulfur-containing free-machining steel), Al (aluminum), or the like. Examples of the materials of the elastic layer 72 include an elastic solid rubber layer, an elastic foam rubber layer, an elastic porous rubber layer, or the like. Examples of the materials of the parting layer 73 include fluorinated resin material.

The roller 70 of this embodiment includes a metal core 71, made of steel, an elastic layer 72 of silicone rubber foam on the metal core 71, and a parting layer 73 of fluorine resin tube on the elastic layer 72. Dimensions of the portion of the roller 70 having the elastic layer 72 and the parting layer 73 are approx. 25 mm in outer diameter, and approx. 330 mm in length.

A thermister 630 is a temperature sensor provided on a back side of the heater 600 (opposite side from the sliding surface side). The thermister 630 is bonded to the heater 600 in a state in which it is insulated from the heat generating element 620. The thermister 630 has a function of detecting a temperature of the heater 600. As shown in FIG. 5, the thermister 630 is connected with a control circuit 100 through an A/D converter (unshown) and feeds an output corresponding to the detected temperature to the control circuit 100.

The control circuit 100 comprises a circuit including a CPU operating for various controls, and a non-volatilization medium such as a ROM storing various programs. The programs are stored in the ROM, and the CPU reads and executes them to affect the various controls. The control circuit 100 may be an integrated circuit such as ASIC if it is capable of performing the similar operation.

As shown in FIG. 5, the control circuit 100 is electrically connected with the voltage source 110 so as to control is electric power supply from the voltage source 110. The control circuit 100 is electrically connected with the thermister 630 to receive the output of the thermister 630.

The control circuit 100 uses the temperature information acquired from the thermister 630 for the electric power supply control for the voltage source 110. More particularly, the control circuit 100 controls the electric power to the heater 600 through the voltage source 110 on the basis of the output of the thermister 630. In this embodiment, the control circuit 100 carries out a wave number control of the output of the voltage source 110 to adjust an amount of heat generation of the heater 600. By such a control, the heater 600 is maintained at a predetermined temperature (approx. 180 degree C., for example).

As shown in FIG. 3, the metal core 71 of the roller 70 is rotatably held by bearings 41*a* and 41*b* provided in a rear side and a front side of the side plate 41, respectively. One axial end of the metal core 71 is provided with a gear G to transmit the driving force from a motor M to the metal core 71 of the roller 70. As shown in FIG. 2, the roller 70 receiving the driving force from the motor M rotates in the direction indicated by the arrow (clockwise direction). In the nip N, the driving force is transmitted to the belt 603 by the way of the roller 70, so that the belt 603 is rotated in the direction indicated by the arrow (counterclockwise direction).

The motor M is a driving portion for driving the roller 70 through the gear G. As shown in FIG. 5, the control circuit 100 is electrically connected with the motor M to control the electric power supply to the motor M. When the electric energy is supplied by the control of the control circuit 100, the motor M starts to rotate the gear G.

The control circuit 100 controls the rotation of the motor M. The control circuit 100 rotates the roller 70 and the belt 603 using the motor M at a predetermined speed. It controls the motor so that the speed of the sheet P nipped and fed by the nip N in the fixing process operation is the same as a predetermined process speed (approx. 200 [mm/sec], for example).

[Heater]

Figure 4:
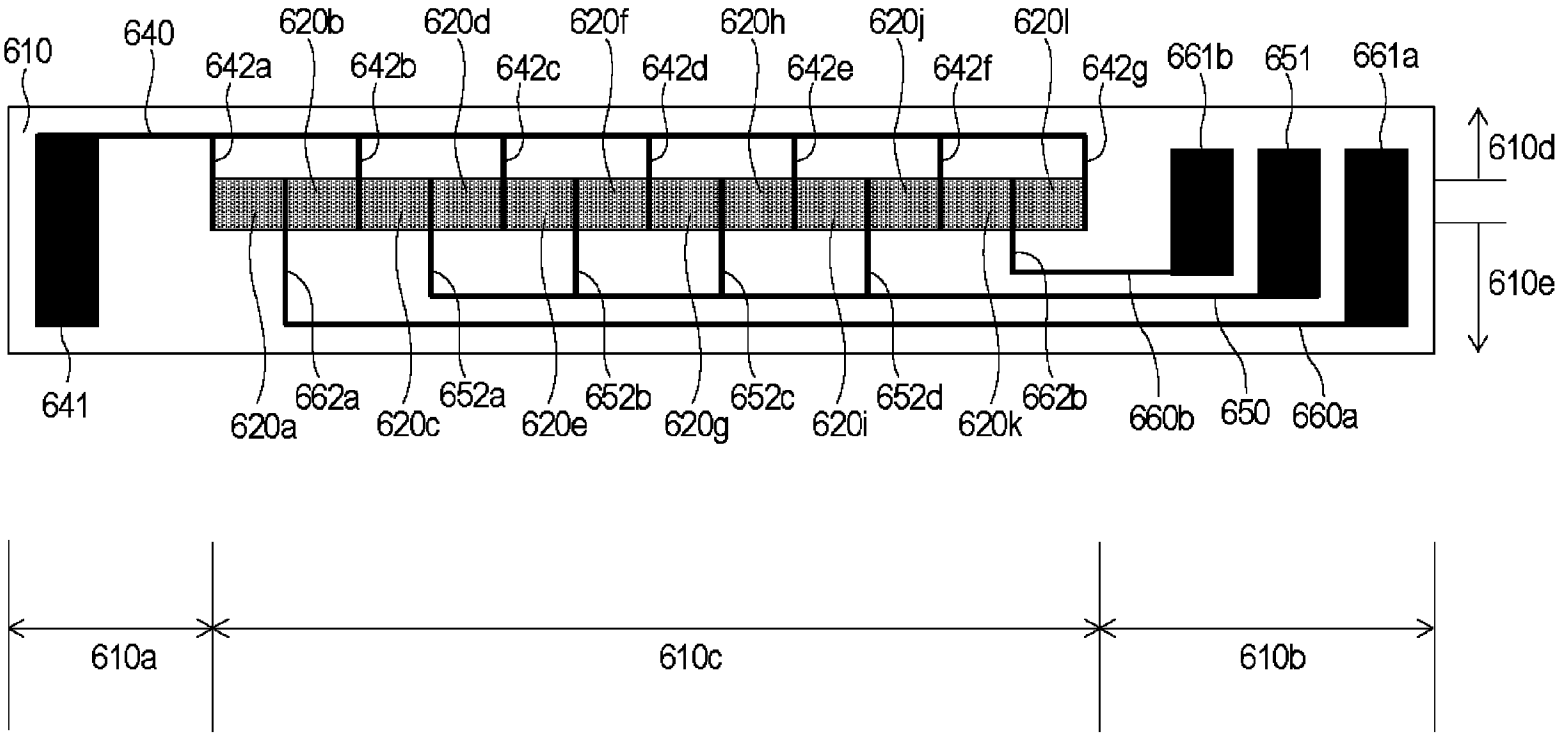
FIG. 4 illustrates a structure of a heater according to Embodiment 1 of the present invention.
Figure 6:
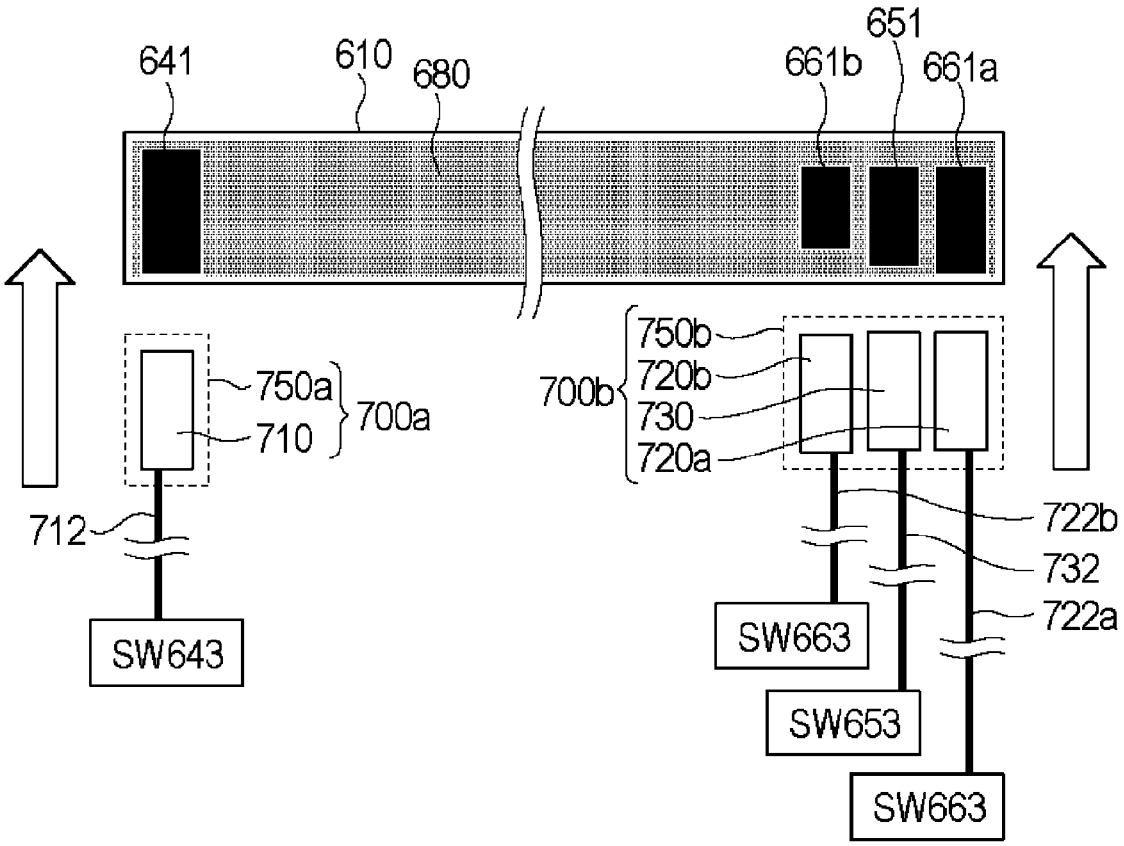
FIG. 6 illustrates a connector.
Figure 13:
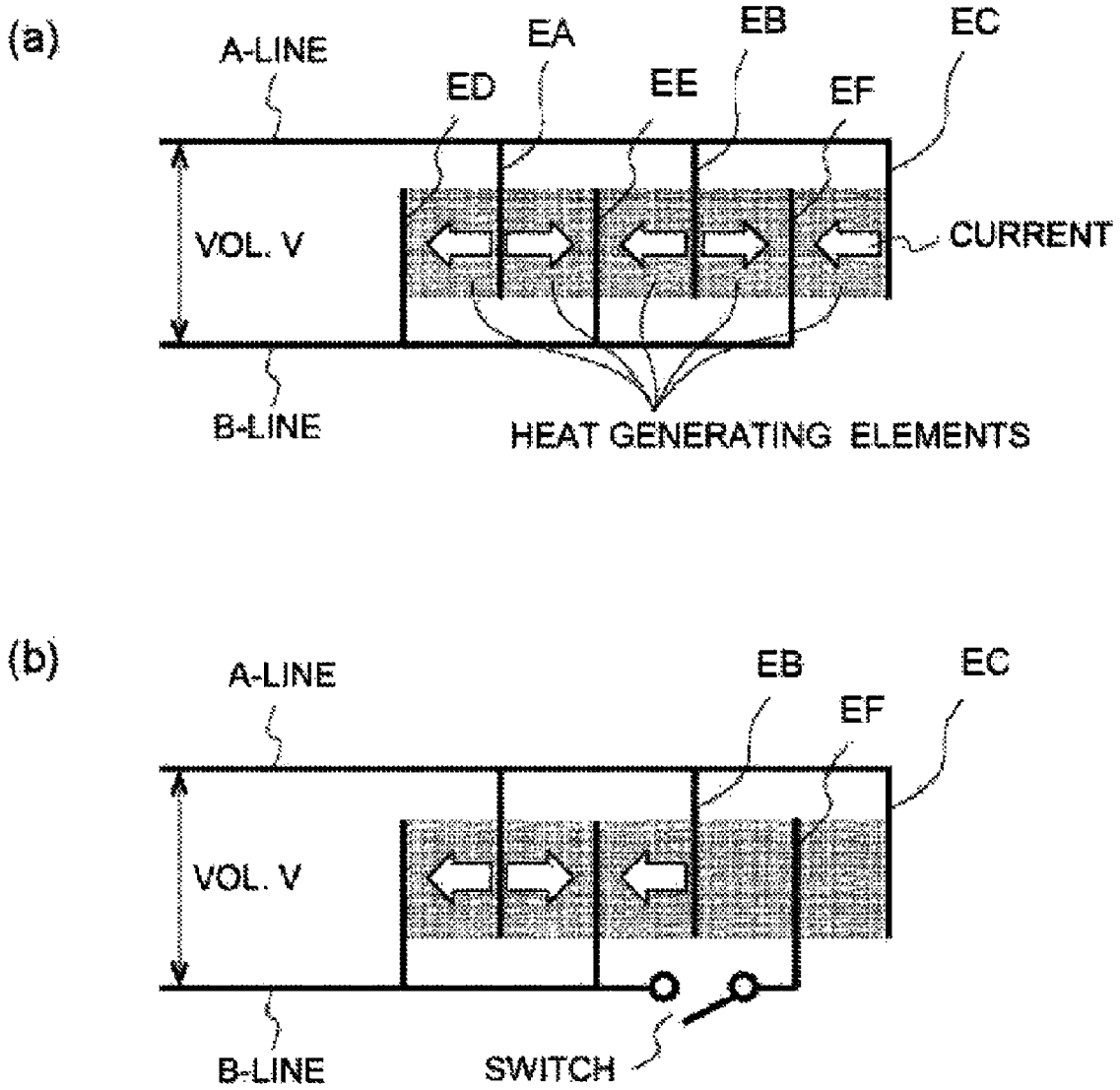
FIG. 13 is an illustration (a) of a heat generating type used with a heater, and an illustration (b) of a switching type for a heat generating region used with the heater.

The structure of the heater 600 used in the fixing device 40 will be described in detail. FIG. 4 illustrates a structure of a heater of Embodiment 1. FIG. 6 illustrates a connector. Part (a) of FIG. 13 illustrates a heat generating type used in the heater 600. Part (b) of FIG. 13 illustrates a heat generating region switching type used with the heater 600.

The heater 600 of this embodiment is a heater using the heat generating type shown in parts (a) and (b) of FIG. 13. As shown in part (a) of FIG. 13, first-third electrodes, EA, EB, and EC, are electrically connected with the A-electroconductive-line, and fourth-sixth electrodes, ED, EE, and EF, are electrically connected with B-electroconductive-line. The electrodes connected with the A-electroconductive-lines and the electrodes connected with the B-electroconductive-lines are interlaced (alternately arranged) along the longitudinal direction (left-right direction in part (a) of FIG. 13), and heat generating elements are electrically connected between the adjacent electrodes. When a voltage V is applied between the A-electroconductive-line and the B-electroconductive-line, a potential difference is generated between the adjacent electrodes. As a result, electric currents flow through the heat generating elements, and the directions of the electric currents through the adjacent heat generating elements are opposite to each other. In this type of heater, the heat is generated in the above-described the manner. As shown in part (b) of FIG. 13, between the B-electroconductive-line and the sixth electrode EF, a switch or the like is provided, and when the switch is opened, the second electrode EB and the sixth electrode EF are at the same potential, and therefore, no electric current flows through the heat generating element therebetween. In this system, the heat generating elements arranged in the longitudinal direction are independently energized so that only a part of the heat generating elements can be energized by switching a part off. In other words, in the system, the heat generating region can be changed by providing a switch or the like in the electroconductive line. In the heater 600, the heat generating region of the heat generating element 620 can be changed using the above-described system.

The heat generating element generates heat when energized, irrespective of the direction of the electric current, but it is preferable that the heat generating elements and the electrodes are arranged so that the currents flow along the longitudinal direction. Such an arrangement is advantageous over the arrangement in which the directions of the electric currents are in the widthwise direction perpendicular to the longitudinal direction (up-down direction in part (a) of FIG. 11) in the following point. When joule heat generation is effected by the electric energization of the heat generating element, the heat generating element generates heat correspondingly to the resistance value thereof, and therefore, the dimension and the material of the heat generating element are selected in accordance with the direction of the electric current so that the resistance value is at a desired level. The dimension of the substrate on which the heat generating element is provided is very short in the widthwise direction as compared with that in the longitudinal direction. Therefore, if the electric current flows in the widthwise direction, it is difficult to provide the heat generating element with a desired resistance value, using a low resistance material. On the other hand, when the electric current flows in the longitudinal direction, it is relatively easy to provide the heat generating element with a desired resistance value, using the low resistance material. In addition, when a high resistance material is used for the heat generating element, a temperature non-uniformity may result from non-uniformity in the thickness of the heat generating element when it is energized. For example, when the heat generating element material is applied on the substrate along the longitudinal direction by screen printing or like, a thickness non-uniformity of about 5% may result in the widthwise direction. This is because a heat generating element material painting non-uniformity occurs due to a small pressure difference in the widthwise direction by a painting blade. For this reason, it is preferable that the heat generating elements and the electrodes are arranged so that the electric currents flow in the longitudinal direction.

In the case that the electric power is supplied individually to the heat generating elements arranged in the longitudinal direction, it is preferable that the electrodes and the heat generating elements are disposed such that the directions of the electric current flow alternates between adjacent heat generating elements. As to the arrangements of the heat generating elements and the electrodes, it would be considered to arrange the heat generating elements each connected with the electrodes at the opposite ends thereof, in the longitudinal direction, and the electric power is supplied in the longitudinal direction. However, with such an arrangement, two electrodes are provided between adjacent heat generating elements, with the result of the likelihood of a short circuit. In addition, the number of required electrodes is large a result of a large non-heat generating portion between the adjacent heat generating elements. Therefore, it is preferable to arrange the heat generating elements and the electrodes such that an electrode is made common between adjacent heat generating elements. With such an arrangement, the likelihood of the short circuit between the electrodes can be avoided, and the non-heat generating portion can be made small.

In this embodiment, a common electroconductive line 640 corresponds to A-electroconductive-line of part (a) of FIG. 13, and opposite electroconductive lines 650, 660*a*, 660*b* correspond to B-electroconductive-line. In addition, common electrodes 642*a*-642*g* correspond to the first-third electrodes of part (a) of FIG. 13, and opposite electrodes 652*a*-652*d*, 662*a*, and 662*b* correspond to the fourth-sixth electrodes. Heat generating elements 620*a*-620*l* correspond to the heat generating elements of part (a) of FIG. 13. Hereinafter, the common electrodes 642*a*-642*g* are simply common electrode 642. The opposite electrodes 652*a*-652*e* are simply called opposite electrode 652. The opposite electroconductive lines 660*a*, 660*b* are simply called opposite electroconductive line 660. The heat generating elements 620*a*-620*l* are simply called heat generating element 620. The structure of the heater 600 will be described in detail referring to the accompanying drawings.

As shown in FIGS. 4 and 6, the heater 600 comprises the substrate 610, the heat generating element 620 on the substrate 610, an electroconductor pattern (electroconductive line), and an insulation coating layer 680 covering the heat generating element 620 and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride, or the like, which has high heat resistivity, thermo-conductivity, electrical insulative property, or the like. In this embodiment, the substrate is a plate member of alumina having a length (measured in the left-right direction in FIG. 4) of approx. 400 mm, a width (up-down direction in FIG. 4) of approx. 8 mm, and a thickness of approx. 1 mm.

On the back side of the substrate 610, the heat generating element 620 and the electroconductor pattern (electroconductive line) are provided through a thick film printing method (screen printing method) using an electroconductive thick film paste. In this embodiment, a silver paste is used for the electroconductor pattern so that the resistivity is low, and a silver-palladium alloy paste is used for the heat generating element 620 so that the resistivity is high. As shown in FIG. 6, the heat generating element 620 and the electroconductor pattern coated with the insulation coating layer 680 of heat resistive glass so that they are electrically protected from leakage and short circuit.

As shown in FIG. 4, there are provided electrical contacts 641 as a part of the electroconductor pattern in one end portion side of the substrate 610 with respect to the longitudinal direction. In the other end portion side 610*b* of the substrate 610 with respect to the longitudinal direction, there are provided the electrical contacts 651, 661*a*, 661*b* as a part of the electroconductor pattern. In a central region 610*c* of the substrate 610 with respect to the longitudinal direction, the heat generating element 620 and the common electrode 642 and the opposite electrodes 652, 662 as a part of the electroconductor pattern are provided. In one end portion side 610*d* of substrate 610 beyond the heat generating element 620 with respect to the widthwise direction, the common electroconductive line 640 as a part of the electroconductor pattern is provided. In the other end portion side 610*e* of the substrate 610 beyond the heat generating element 620 with respect to the widthwise direction, the opposite electroconductive lines 650 and 660 are provided as a part of the electroconductor pattern.

The heat generating elements 620 (620*a*-620*l*) are resistors for generating joule heat upon electric power supply thereto. The heat generating element 620 is one heat generating element member extending in the longitudinal direction on the substrate 610, and is disposed in the region 610*c* (FIG. 4) adjacent to the center portion of the substrate 610. The heat generating element 620 has a desired resistance value, and has a width (measured in the widthwise direction of the substrate 610) of 1-4 mm, and a thickness of 5-20 μm. The heat generating element 620 in this embodiment has the width of approx. 2 mm and the thickness of approx. 10 μm. A total length of the heat generating element 620 in the longitudinal direction is approx. 320 mm, which is enough to cover a width of the A4 size sheet P (approx. 297 mm in width).

On the heat generating element 620, seven common electrodes 642*a*-642*g*, which will be described hereinafter, are laminated with intervals in the longitudinal direction. In other words, the heat generating element 620 is isolated into six sections by common electrodes 642*a*-642*g* along the longitudinal direction. The lengths measured in the longitudinal direction of the substrate 610 of each section are approx. 53.3 mm. On central portions of the respective sections of the heat generating element 620, one of the six opposite electrodes 652, 662 (652*a*-652*d*, 662*a*, 662*b*) are laminated. In this manner, the heat generating element 620 is divided into 12 sub-sections. The heat generating element 620 divided into 12 sub-sections can be deemed as a plurality of heat generating elements 620*a*-620*l*. In other words, the heat generating elements 620*a*-620*l* electrically connect adjacent electrodes with each other. Lengths of the sub-section measured in the longitudinal direction of the substrate 610 are approx. 26.7 mm. Resistance values of the sub-section of the heat generating element 620 with respect to the longitudinal direction are approx. 120Ω. With such a structure, the heat generating element 620 is capable of generating heat in a partial area or areas with respect to the longitudinal direction.

The resistivities of the heat generating elements 620 with respect to the longitudinal direction are uniform, and the heat generating elements 620*a*-620*l* have substantially the same dimensions. Therefore, the resistance values of the heat generating elements 620*a*-620*l* are substantially equal. When they are supplied with electric power in parallel, the heat generation distribution of the heat generating element 620 is uniform. However, it is not inevitable that the heat generating elements 620*a*-620*l* have substantially the same dimensions and/or substantially the same resistivities. For example, the resistance values of the heat generating elements 620*a* and 620*l* may be adjusted so as to prevent temperature lowering at the longitudinal end portions of the heat generating element 620. At the positions of the heat generating element 620 where the common electrode 642 and the opposite electrode 652, 662 are provided, the heat generation of the heat generating element 620 is substantially zero. However, the heat uniforming function of the substrate 610 makes the influence on the fixing process negligible if the width of the electrode is not more than 1 mm, for example. In this embodiment, the width of each electrode is not more than 1 mm. The common electrodes 642 (642*a*-642*g*) are a part of the above-described electroconductor pattern. The common electrode 642 extends in the widthwise direction of the substrate 610 perpendicular to the longitudinal direction of the heat generating element 620. In this embodiment, the common electrode 642 is laminated on the heat generating element 620. The common electrodes 642 are odd-numbered electrodes of the electrodes connected to the heat generating element 620, as counted from one longitudinal end of the heat generating element 620. The common electrode 642 is connected to one contact 110*a* of the voltage source 110 through the common electroconductive line 640 which will be described hereinafter.

The opposite electrodes 652, 662 are a part of the above-described electroconductor pattern. The opposite electrodes 652, 662 extend in the widthwise direction of the substrate 610 perpendicular to the longitudinal direction of the heat generating element 620. The opposite electrodes 652, 662 are laminated on the heat generating element 620. The opposite electrodes 652, 662 are the other electrodes of the electrodes connected with the heat generating element 620 other than the above-described common electrode 642. That is, in this embodiment, they are even-numbered electrodes as counted from the one longitudinal end of the heat generating element 620.

That is, the common electrode 642 and the opposite electrodes 662, 652 are alternately arranged along the longitudinal direction of the heat generating element. The opposite electrodes 652, 662 are connected to the other contact 110*b* of the voltage source 110 through the opposite electroconductive lines 650, 660 which will be described hereinafter.

The common electrode 642 and the opposite electrodes 652, 662 function as a plurality of electrode portions for supplying the electric power to the heat generating element 620.

In this embodiment, the odd-numbered electrodes are common electrodes 642, and the even-numbered electrodes are opposite electrodes 652, 662, but the structure of the heater 600 is not limited to this example. For example, the even-numbered electrodes may be the common electrodes 642, and the odd-numbered electrodes may be the opposite electrodes 652, 662.

In addition, in this embodiment, four of the opposite electrodes connected with the heat generating element 620 are the opposite electrode 652. In this embodiment, two of the opposite electrodes connected with the heat generating element 620 are the opposite electrode 662. However, the allotment of the opposite electrodes is not limited to this example, but may be changed depending on the heat generation widths of the heater 600. For example, two may be the opposite electrode 652, and four maybe the opposite electrode 662.

The common electroconductive line 640 is a part of the above-described electroconductor pattern. The common electroconductive line 640 extends along the longitudinal direction of the substrate 610 toward the one end portion side 610*a* of the substrate in the one end portion side 610*d* of the substrate. The common electroconductive line 640 is connected with the common electrodes 642 (642*a*-642*g*) which is in turn connected with the heat generating element 620 (620*a*-620*l*). The common electroconductive line 640 is connected to the electrical contact 641 which will be described hereinafter. In this embodiment, in order to assure the insulation of the insulation coating layer 680, a gap of approx. 400 μm is provided between the common electroconductive line 640 and each opposite electrode.

The opposite electroconductive line 650 is a part of the above-described electroconductor pattern. The opposite electroconductive line 650 extends along the longitudinal direction of substrate 610 toward the other end portion 610*b* of the substrate in the other end portion side 610*e* of the substrate. The opposite electroconductive line 650 is connected with the opposite electrodes 652 (652*a*-652*d*) which are in turn connected with heat generating elements 620 (620*c*-620*j*). The opposite electroconductive line 650 is connected to the electrical contact 651 which will be described hereinafter.

The opposite electroconductive line 660 (660*a*, 660*b*) is a part of the above-described electroconductor pattern. The opposite electroconductive line 660*a* extends along the longitudinal direction of substrate 610 toward the other end portion 610*a* of the substrate in the other end portion side 610*e* of the substrate. The opposite electroconductive line 660*a* is connected with the opposite electrode 662*a* which is in turn connected with the heat generating element 620 (620*a*, 620*b*). The opposite electroconductive line 660*a* is connected to the electrical contact 661*a* which will be described hereinafter. The opposite electroconductive line 660*b* extends along the longitudinal direction of substrate 610 toward the other end portion 610*b* of the substrate in the other end portion side 610*e* of the substrate. The opposite electroconductive line 660*b* is connected with the opposite electrode 662*a* which is in turn connected with the heat generating element 620 (620*k*, 620*l*). The opposite electroconductive line 660*b* is connected to the electrical contact 661*b* which will be described hereinafter. In this embodiment, in order to assure the insulation of the insulation coating layer 680, a gap of approx. 400 μm is provided between the opposite electroconductive line 660*b* and the common electrode 642. In addition, between the opposite electroconductive lines 660*a* and 650 and between the opposite electroconductive lines 660*b* and 650, gaps of approx. 100 μm are provided.

The electrical contacts 641, 651, 661*a*, 661*b* are a part of the above-described electroconductor pattern. In the one end portion side 610*a* of the substrate, the electrical contact is provided. In the other end portion side 610*b* of the substrate, electrical contacts 651, 661*a*, 661*b* are provided. As shown in FIG. 6, the portion including the electrical contacts 641, 651, 661*a*, 661*b* is not coated with the insulation coating layer 680, so that the electrical contacts 641, 651, 661*a*, 661*b* are exposed. Therefore, the electrical contact 641 can be contacted with and electrically connected with the connector 700*a*. The electrical contacts 651, 661*a*, 661*b* can be contacted with and electrically connected with the connector 700*b*.

When voltage is applied between the electrical contact 641 and the electrical contact 651 through the connection between the heater 600 and the connector 700, a potential difference is produced between the common electrode 642 (642*b*-642*f*) and the opposite electrode 652 (652*a*-652*d*). Therefore, through the heat generating elements 620*c*, 620*d*, 620*e*, 620*f*, 620*g*, 620*h*, 620*i*, 620*j*, the currents flow along the longitudinal direction of the substrate 610, the directions of the currents through the adjacent heat generating elements being substantially opposite to each other. The heat generating elements 620*c*, 620*d*, 620*e*, 620*f*, 620*g*, 620*h*, 620*i* as a first heat generating region generate heat, respectively.

When voltage is applied between the electrical contact 641 and the electrical contact 661*a* through the connection between the heater 600 and the connector 700, a potential difference is produced between the common electrodes 642*a* and 642*b* and the opposite electrode 662*a*. Therefore, through the heat generating elements 620*a*, 620*b*, the currents flow along the longitudinal direction of the substrate 610, the directions of the currents through the adjacent heat generating elements being substantially opposite to each other. The heat generating elements 620*a*, 620*b* as a second heat generating region generate heat.

When voltage is applied between the electrical contact 641 and the electrical contact 661*b* through the connection between the heater 600 and the connector 700, a potential difference is produced between the common electrodes 642*f* and 642*g* and the opposite electrode 662*a* through the common electroconductive line 640 and the opposite electroconductive line 660*b*. Therefore, through the heat generating elements 620*k*, 620*l*, the currents flow along the longitudinal direction of the substrate 610, the directions of the currents through the adjacent heat generating elements being substantially opposite to each other. The heat generating elements 620*k*, 620*l* as a third heat generating region generate heat.

In this manner, by selecting the electrical contacts supplied with the voltage, the desired one or ones of the heat generating elements 620*a*-620*l* can be selectively energized.

[Connector]

Figure 7:
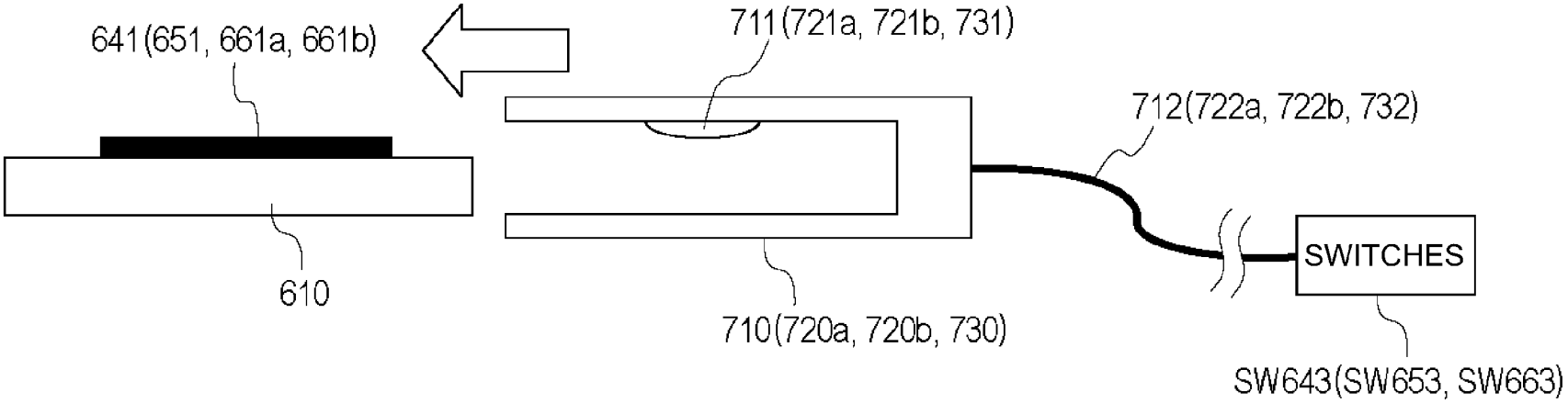
FIG. 7 illustrates a connector.

The connector 700 used with the fixing device 40 will be described in detail. FIG. 7 illustrates a contact terminal. The connectors 700*a* and 700*b* of this embodiment are electrically connected with the heater 600 by mounting to the heater 600. As shown in FIG. 6, the connector 700*a* comprises a contact terminal 710 electrically connectable with the electrical contact 641. The contact terminal 710 is covered by a housing 750*a*. The connector 700*b* includes a contact terminal 720*a* electrically connectable with the electrical contact 661*a*, a contact terminal 720*b* electrically connectable with the electrical contact 661*b*, and a contact terminal 730 electrically connectable with the electrical contact 651. Contact terminals 720*a*, 720*b*, 730 are all in a housing 750*b*. The connectors 700*a*, 700*b* are mounted to the heater 600 so as to nip the heater 600 at the front and back surface thereof, by which the contact terminals are connected to the electrical contacts, respectively. In the fixing device 40 of this embodiment having the above-described the structures, no soldering or the like is used for the electrical connection between the connectors and the electrical contacts. Therefore, the electrical connection between the heater 600 and the connector 700 which rise in temperature during the fixing process operation can be accomplished and maintained with high reliability. In the fixing device 40 of this embodiment, the connector 700 is detachably mountable relative to the heater 600, and therefore, the belt 603 and/or the heater 600 can be replaced without difficulty. The structure of the connector 700 will be described in detail.

As shown in FIG. 6, the connector 700 provided with the metal contact terminals 710 is mounted to the heater 600 in the widthwise direction of the substrate 610 at one end portion side 610*a* of the substrate, from an end portion of the substrate 610 with respect to the widthwise direction. The connector 700*b* provided with the contact terminals 720*b*, 730 is mounted to the heater 600 from the longitudinal end portion in the other end portion side 610*b* of the substrate.

The exchange of the belt 603 and/or heater 600 is desirably carried out with mounting and demounting of the connector 700*a*. This is because the connector 700*a* has only one contact terminal, and therefore, even if the mounting position relative to the heater 600 is slightly deviated, the contact terminal does not likely to connect with an electrical contact other than the electrical contact 641 (no liability of short circuit). In other words, with the structure of this embodiment, the mounting and demounting of the connector 700*a* relative to the heater 600 can be carried out further safely. The structure of the connector 700 will be described in detail.

The contact terminals 710, 720*a*, 720*b*, 730 will be described, taking the contact terminal 710 for instance. The contact terminal 710 functions to electrically connect the electrical contact 641 to a switch SW643 which will be described hereinafter. As shown in FIG. 7, the contact terminal 710 is provided with a cable 712 for the electrical connection between the switch SW643 and the electrical contact 711 for contacting to the electrical contact 641. The contact terminal 710 has a channel-like configuration, and by moving in the direction indicated by an arrow in FIG. 6, it can receive the heater 600. The portion of the contact terminal 710 which contacts the electrical contact is provided with the electrical contact 711 which contacts the electrical contact 641, by which the electrical connection is established between the electrical contact 641 and the contact terminal 710. The electrical contact 711 has a leaf spring property, and therefore, contacts the electrical contact 641 while pressing against it. Therefore, the contact 710 sandwiches the heater 600 between the front and back sides to fix the position of the heater 600.

Similarly, the contact terminal 720*a* functions to contact the electrical contact 661*a* with the switch SW663 which will be described hereinafter. The contact terminal 720*a* is provided with a cable 722*a* for the electrical connection between the switch SW643 and the electrical contact 721*a* for contacting to the electrical contact 661*a*.

Similarly, the contact terminal 720*b* functions to contact the electrical contact 661*b* with the switch SW663 which will be described hereinafter. The contact terminal 720*b* is provided with a cable 722*b* for the electrical connection between the switch SW663 and the electrical contact 721*b* for contacting to the electrical contact 661*b*.

Similarly, the contact terminal 730 functions to contact the electrical contact 651 with the switch SW653 which will be described hereinafter. The contact terminal 730 is provided with a cable 732 for the electrical connection between the switch SW653 and the electrical contact 731 for contacting to the electrical contact 651.

The contact terminal 710 of metal is integrally supported by a housing 750*a* of resin material. The contact terminal 710 is disposed in the housing 750*a* so as to be connectable with the electrical contact 641 when the connector 700*a* is mounted to the heater 600.

The contact terminals 720*a*, 720*b*, 730 of metal are integrally supported by a housing 750*b* of resin material. The contact terminals 720*b*, 720*b*, 730 are provided in the housing 750*b* with spaces between adjacent ones so as to be connectable with the electrical contacts 661*a*, 661*b*, 651, respectively when the connector 700 is mounted to the heater 600. Between adjacent contact terminals, partitions are provided to electrically insulate between the adjacent contact terminals.

In this embodiment, the connector 700 is mounted in the widthwise direction of the substrate 610, but this mounting method is not limited to the present invention. For example, the structure may be such that the connector 700 is mounted in the longitudinal direction of the substrate.

[Electric Energy Supply to Heater]

An electric energy supply method to the heater 600 will be described The fixing device 40 of this embodiment is capable of changing a width of the heat generating region of the heater 600 by controlling the electric energy supply to the heater 600 in accordance with the width size of the sheet P. With such a structure, the heat can be efficiently supplied to the sheet P. In the fixing device 40 of this embodiment, the sheet P is fed with the center of the sheet P aligned with the center of the fixing device 40, and therefore, the heat generating region extends from the center portion. The electric energy supply to the heater 600 will be described in conjunction with the accompanying drawings.

The voltage source 110 is a circuit for supplying the electric power to the heater 600. In this embodiment, the commercial voltage source (AC voltage source) of approx. 100V in effective value (single phase AC). The voltage source 110 of this embodiment is provided with a voltage source contact 110*a* and a voltage source contact 110*b* having different electric potential. The voltage source 110 may be DC voltage source if it has a function of supplying the electric power to the heater 600.

As shown in FIG. 5, the control circuit 100 is electrically connected with switch SW643, switch SW653, and switch SW663, respectively to control the switch SW643, switch SW653, and switch SW663, respectively.

Switch SW643 is a switch (relay) provided between the voltage source contact 110*a* and the electrical contact 641. The switch SW643 connects or disconnects between the voltage source contact 110*a* and the electrical contact 641 in accordance with the instructions from the control circuit 100. The switch SW653 is a switch provided between the voltage source contact 110*b* and the electrical contact 651. The switch SW643 connects or disconnects between the voltage source contact 110*b* and the electrical contact 651 in accordance with the instructions from the control circuit 100. The switch SW663 is a switch provided between the voltage source contact 110*b* and the electrical contact 661 (661*a*, 661*b*). The switch SW663 connects or disconnects between the voltage source contact 110*b* and the electrical contact 661 (661*a*, 661*b*) in accordance with the instructions from the control circuit 100.

When the control circuit 100 receives the execution instructions of a job, the control circuit 100 acquires the width size information of the sheet P to be subjected to the fixing process. In accordance with the width size information of the sheet P, a combination of ON/OFF of the switch SW643, switch SW653, switch SW663 is controlled so that the heat generation width of the heat generating element 620 fits the sheet P. At this time, the control circuit 100, the voltage source 110, switch SW643, switch SW653, switch SW663 and the connector 700 function as an electric energy supplying portion for supplying the electric power to the heater 600.

When the sheet P is a large size sheet (an usable maximum width size), that is, when the A3 size sheet is fed in the longitudinal direction or when the A4 size sheet is fed in the landscape fashion, the width of the sheet P is approx. 297 mm. Therefore, the control circuit 100 controls the electric power supply to provide the heat generation width B (FIG. 5) of the heat generating element 620. To effect this, the control circuit 100 renders ON all of the switches SW643, switch SW653, switch SW663. As a result, the heater 600 is supplied with the electric power through the electrical contacts 641, 661*a*, 661*b*, 651, and all of the 12 sub-sections of the heat generating element 620 generate heat. At this time, the heater 600 generates the heat uniformly over the approx. 320 mm region to meet the approx. 297 mm sheet P.

When the size of the sheet P is a small size (narrower than the maximum width), that is, when an A4 size sheet is fed longitudinally, or when an A5 size sheet is fed in the landscape fashion, the width of the sheet P is approx. 210 mm. Therefore, the control circuit 100 provides a heat generation width A (FIG. 5) of the heat generating element 620. Therefore, the control circuit 100 renders ON the switch SW643, switch SW653 and renders OFF the switch SW663. As a result, the heater 600 is supplied with the electric power through the electrical contacts 641, 651, so that 8 sub-sections of the 12 sub-sections of the heat generating element 620 generate heat. At this time, the heater 600 generates the heat uniformly over the approx. 213 mm region to meet the approx. 210 mm sheet P.

[Arrangement of Electrical Contact]

Figure 8:
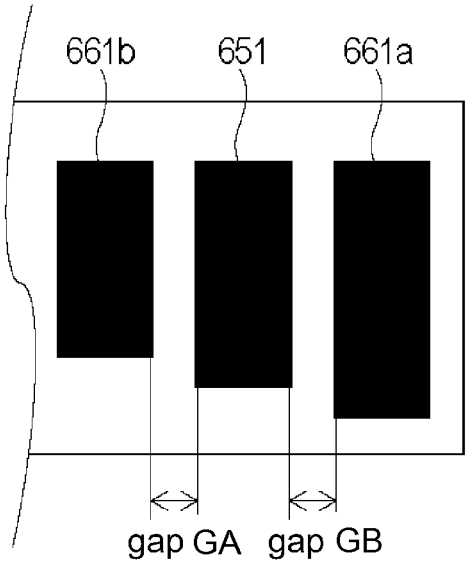
FIG. 8 illustrates an arrangement of the electrical contacts according to Embodiment 1 of the present invention.

The disposition or arrangement of the electrical contacts will be described. FIG. 8 shows the arrangement of the electrical contacts in this embodiment. In this embodiment, the common electroconductive line 640 connected to the voltage source contact 110*a* is disposed in the one end portion side 610*a* of the substrate, and the opposite electroconductive lines 650, 660*a*, 660*b* connected to the voltage source contact 110*b* are disposed in the other end portion side 610*b* of the substrate with respect to the widthwise direction of the substrate. By this arrangement, the short circuit between the electroconductive lines is prevented. In this embodiment, the electrical contact connected to the voltage source contact 110*a* is disposed in one end portion side 610*a* of the substrate, and the electrical contact connected to the voltage source contact 110*b* is disposed in the one end portion side 610*b* of the substrate, with respect to the longitudinal direction of the substrate. More specifically, the electrical contact 641 is disposed in the one end portion side 610*a* of the substrate, and the electrical contacts 651, 661*a*, 661*b* are disposed at one end portion side 610*b* of the substrate. With such an arrangement in this embodiment, sufficient insulation distances can be assured between the electrical contacts connected to the different voltage source contacts. By reducing the gap between electrical contacts connected to the same voltage source contact, the increase of the length of the substrate resulting from the arrangement of the electrical contacts along the longitudinal direction can be suppressed. Furthermore, by dividing the electrical contacts connected to the different voltage source contacts into the respective end portions with respect to the longitudinal direction of the substrate, a heat generation non-uniformity of the heat generating element attributable to the voltage drop by the electroconductive lines is prevented. The description will be made in detail in conjunction with the accompanying drawings.

As described hereinbefore, in this embodiment, the electrical contact 641 is disposed in the one end portion side 610*a* of the substrate, and the electrical contacts 651, 661*a*, 661*b* are disposed in other end portion side 610*b* of the substrate. Each electrical contact has a size of not less than 2.5 mm×2.5 mm (widthwise direction and longitudinal direction of the substrate) so as to receive the electric energy from the contact terminal assuredly, and the area thereof is preferably lives. In this embodiment, the dimensions of the electrical contact 641 is approx. 7 mm×approx. 3 mm, that of the electrical contact 661*a* is approx. 7 mm×approx. 3 mm, that of the electrical contact 661*b* is approx. 5 mm×approx. 3 mm, and that of the electrical contact 651 is approx. 6 mm×approx. 3 mm.

As described hereinbefore, the portion of the substrate 610 provided with the electrical contacts 641, 651, 661*a*, 661*b* is not coated with the insulation coating layer. That is, the electrical contacts are exposed, and therefore, there is a likelihood of electrical leakage and/or short circuit. The short circuit attributable to the creepage discharge tends to occur between the electrical contacts connected to the different voltage source contacts. It is, therefore, desirable that a sufficient gap (insulation distance) for electrical insulation is provided between electrical contacts connected to the different voltage source contacts. However, the increase of the insulation distance results in the increased size of the substrate 610. Therefore, the arrangements of the electrical contacts are desirably considered so as not to increase the length of the substrate 610.

In the fixing device 40 of this embodiment, the electrical contact connected to the voltage source contact 110*a* and the electrical contact connected to the voltage source contact 110*b* are predetermined. More particularly, the electrical contact 641*a* is connected to the voltage source contact 110*a*, and the electrical contacts 651, 661*a*, 661*b* are connected to the voltage source contact 110*b*. In other words, the electrical contact 641 and the electrical contacts 651, 661*a*, 661*b* are connected to the different voltage source contact (opposite polarities), and therefore a large potential difference is produced therebetween with the result of a relatively higher possibility of the creepage discharge. Under the circumstances, in this embodiment, the electrical contact 641 is disposed in the one end portion side 610*a* of the substrate, and the electrical contacts 651, 661*a*, 661*b* are disposed in the other end portion side 610*b* of the substrate, by which sufficient insulation distances are provided between the electrical contact 641 and the electrical contacts 651, 661*a*, 661*b*.

The electrical contacts 651, 661*a*, 661*b* disposed in the other end portion side 610*b* of the substrates which are disposed adjacent to each other are connected to the same voltage source contact. Therefore, no large potential difference is produced between these electrical contacts. That is, the gap GA between the electrical contacts 651 and 661*b*, and the gap GB between the electrical contacts 651 and 661*a* is large enough to effectively prevent the short circuit attributable to the creepage discharge. Therefore, the gap GA and the gap GB will suffice if insulation is provided to assure the normal operation of the heater 600, and they can be minimized. However, in consideration of the mounting tolerances of the connector 700*b* and/or the possible short circuit attributable to the thermal expansion of the substrate 610, the gap GA and gap GB in this embodiment are approx. 1.5 mm. When the gap between the electrical contacts 651 and 661*b* is not constant because of non-parallelism between the electrical contacts 651 and 661*b*, a minimum value of the gap is deemed as the gap GA. When the gap between the electrical contacts 651 and 661*a* is not constant because of non-parallelism between the electrical contacts 651 and 661*a*, a minimum value of the gap is deemed as the gap GB.

The case in which the electrical contacts connected to the different voltage source contacts are provided adjacent to each other will be considered. Japanese Electrical Appliance and Material Safety Law (annex Table of attached Table) stipulates that in a charging portion or other position of different polarities where a voltage between the lines is 50V-150V, the required space distance (creeping distance) is approx. 2.5 mm. In this embodiment, taking mounting tolerances of the connector 700 and/or the thermal expansion of the substrate 610 into account, a gap GE is approx. 4.0 mm.

By dividing the electrical contacts connected to the different voltage source contacts into the one end portion side 610*a* of the substrate and the other end portion side 610*b*, the gap between the adjacent electrical contacts can be reduced. More specifically, the gap between the adjacent electrical contacts may be reduced to less than 4.0 mm (further preferably less than 2.5 mm). Therefore, upsizing of the substrate in the longitudinal direction due to the arrangement of the electrical contacts along the longitudinal direction can be suppressed.

In addition, in this embodiment, the electrical contact 641 electrically connected to one of the terminals, and the electrical contacts 661*a*, 651, 661*b* electrically connected to the other terminal are disposed in the opposite end portions of the substrate, by which the temperature non-uniformity of the heat generating element with respect to the longitudinal direction can be suppressed.

The heat generating element 620*d* is disposed at a position remoter from the electrical contact than the heat generating element 620*c* with respect to the longitudinal direction of the substrate. Therefore, a length of the path of the electroconductive line 640, connecting the electrical contact 641 and the electrode 642*c*, is longer than a length of the path of the electroconductive line 640 connecting the electrical contact and the electrode 642*b*. On the other hand, the length of the path of the electroconductive line 650 connecting the electrical contact 651 and the electrode 652*a* is longer than the length of the path of the electroconductive line 650 connecting the electrical contact 651 and the electrode 652*b*. In other words, the length of the electroconductive line connecting the heat generating element 620*d* and the electrical contact is longer than the length of the electroconductive line connecting the heat generating element 620*c* and the electrical contact, and the length of the electroconductive line connecting the heat generating element 620*c* and the electrical contact 651 is longer than the length of the electroconductive line connecting the heat generating element 620*d* and the electrical contact 651.

Therefore, the voltage drop attributable to the resistance of the electroconductive lines can be offset between the opposite longitudinal end portions of the substrate. In other words, the production of a difference in the amount of heat generation between the heat generating element 620*d* and the heat generating element 620*c* can be suppressed. The same applies to the other heat generating elements other than the heat generating element 620*d* and the heat generating element 620*c*.

Figure 14:
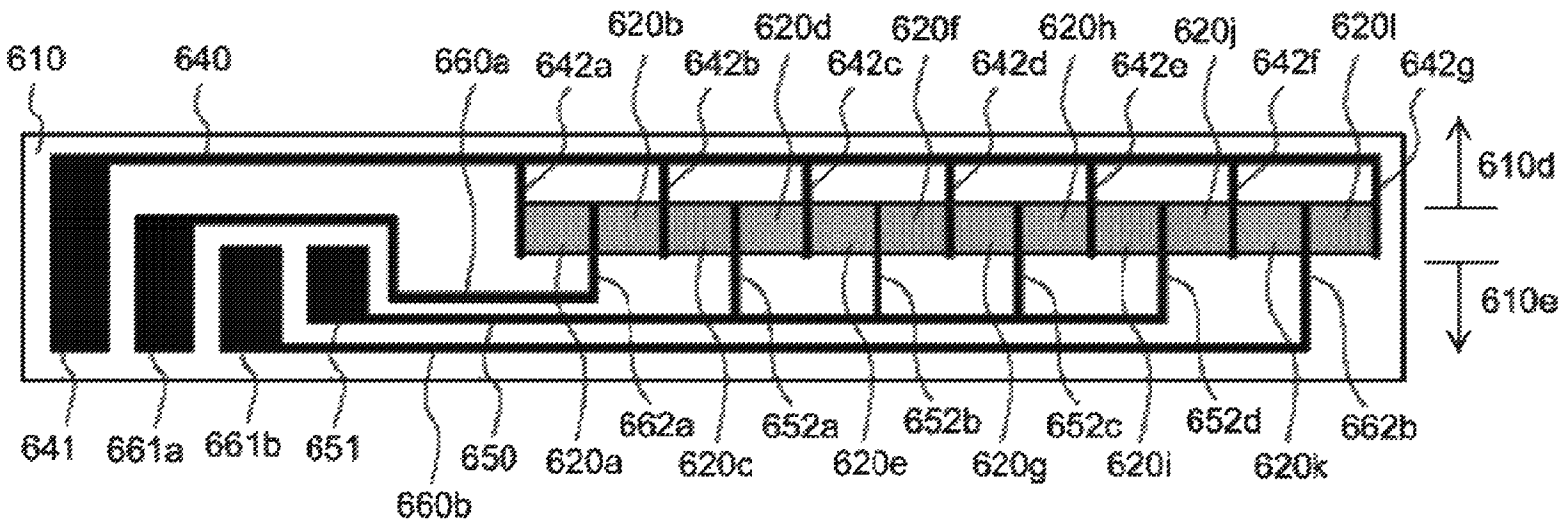
FIG. 14 is an illustration of a heater of a comparison example.

FIG. 14 shows a heater of a comparison example. In this embodiment, the electrical contacts 661*a*, 651, 661*b* are provided in the other end portion side 610*b* of the substrate, but in the comparison example, the electrical contacts 661*a*, 651, 661*b* are provided in the one end portion side 610*a* of the substrate. In other words, all of the electrical contacts are provided in the one end portion side of the substrate. The heater of the comparison example is the same as the heater of this embodiment except for the positions of the electrical contacts 661*a*, 651, 661*b* and the paths of the electroconductive lines 660*a*, 650, 660*b*.

Figure 15:
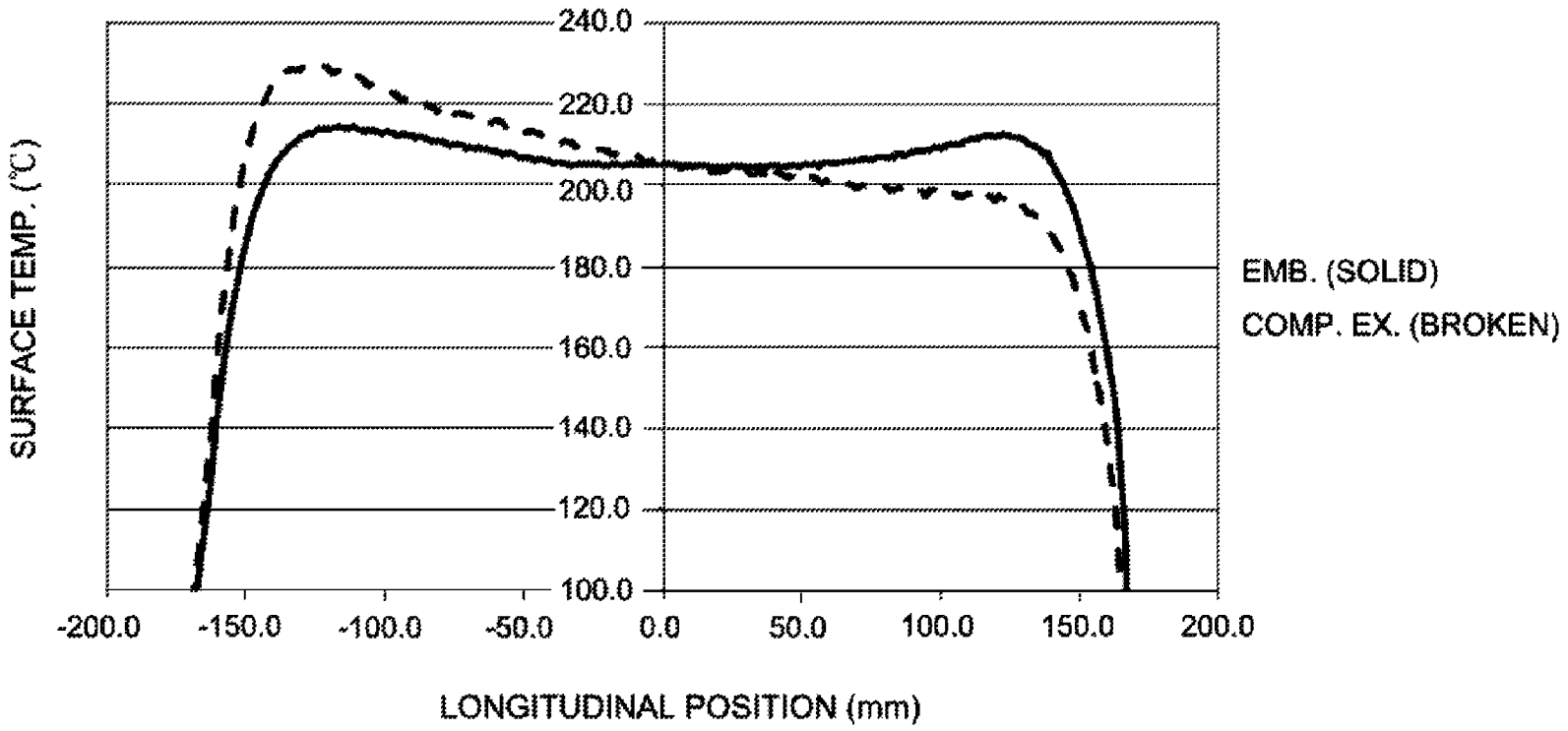
FIG. 15 is a graph of comparison test.

Comparison tests have been carried out using the heater of the comparison example with heater of this embodiment to check the state of the heat generating portion minute of the heat generating element 620. In the comparison tests, a voltage of 100V is applied between the electrical contact 641 and the electrical contacts 661*a*, 651, 661*b*, and the temperature distribution of the heat generating portion 620 several seconds after the voltage application is measured using a thermo-camera, in each of the heater of this embodiment and the heater of the comparison example. FIG. 15 shows the result of the comparison tests. The abscissa of the graph of Figure is a position of the heat generating element in the longitudinal direction based on the longitudinally central position (mm). One end side of the center is indicated by minus sign, and the other end side thereof is indicated by plus sign. The ordinate of the graph of FIG. 15 is the surface temperature of the heat generating element (degree C.).

As shown in FIG. 15, in the comparison example, the temperature of the one end portion of the heat generating element is approx. 230 degrees C., and the temperature of the other end portion of the heat generating element is approx. 200 degrees C. That is, in the comparison example, there is a temperature difference of approx. 30 degrees C. between the opposite end portions of the heat generating element with respect to the longitudinal direction. On the other hand, in the case of this embodiment, the temperatures of the heat generating element at the opposite end portions are approx. 210 degrees C. That is, the temperature difference is small over the longitudinal direction in this embodiment. Therefore, as compared with the fixing device provided with the heater of the comparison example, the fixing device provided with the heater of this embodiment can produce satisfactory images with less gloss non-uniformity.

Embodiment 2

Figure 9:
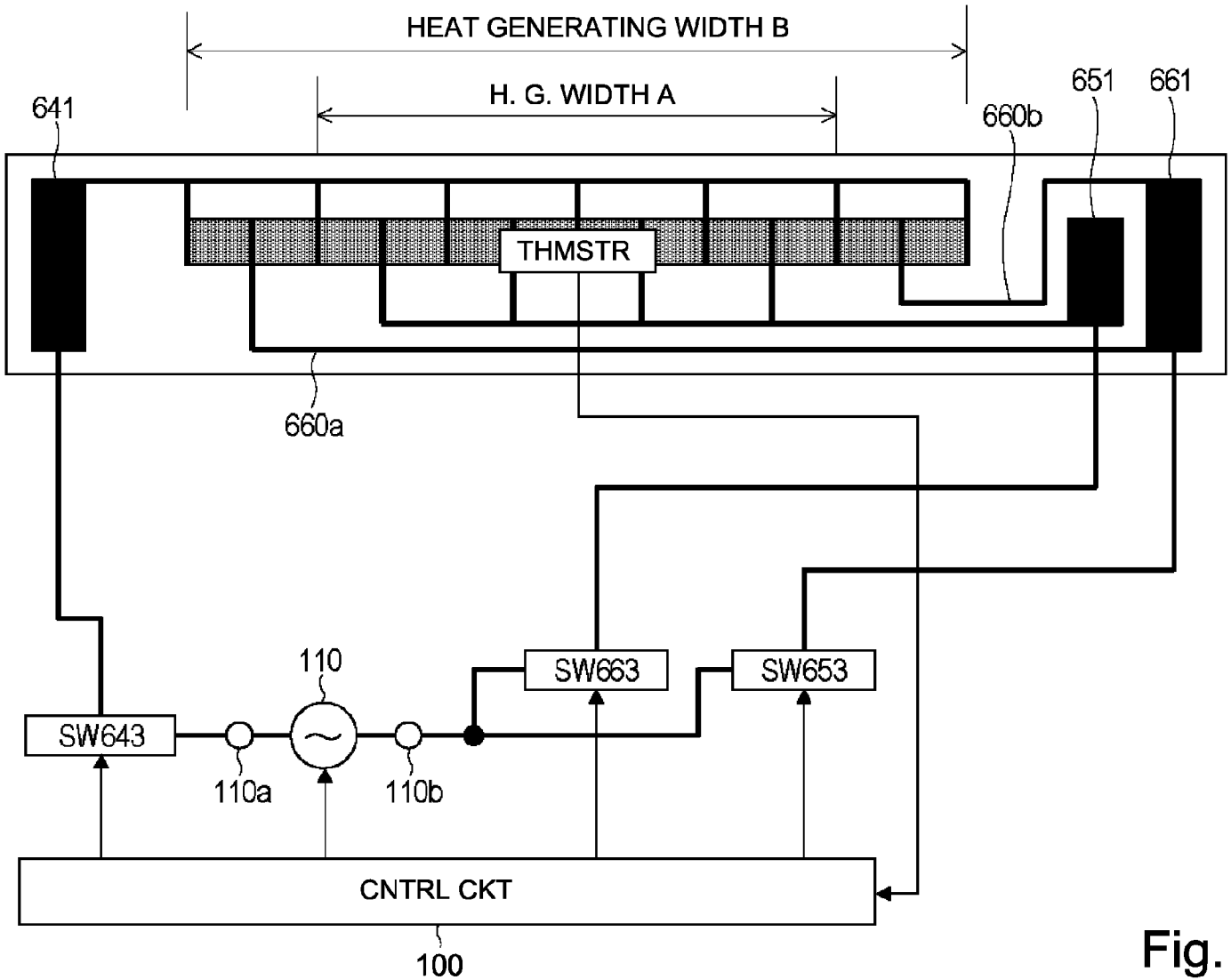
FIG. 9 illustrates the structural relationship of the image heating apparatus according to Embodiment 2 of the present invention.

A heater according to Embodiment 2 of the present invention will be described. FIG. 9 is an illustration of a structural relation of the image heating apparatus of this embodiment. FIG. 8 shows the arrangement of the electrical contacts in this embodiment. In Embodiment 1, the electrical contact 661*a* connected to the opposite electroconductive line 660*a* and the electrical contact 661*b* connected to the opposite electroconductive line 660*b* are provided separately. In this embodiment, an electrical contact 661 connected to the opposite electroconductive line 660*a* and the opposite electroconductive line 660*b* is provided. That is, the electrical contact 661 of this embodiment functions as the electrical contacts 661*a*, 661*b* of Embodiment 1. With the structure of this embodiment, the length of the substrate is reduced. The details of the heater 600 of this embodiment will be described in conjunction with the drawings. The structures of the fixing device 40 of Embodiment 2 are fundamentally the same as the those of Embodiment 1 except for the structures relating to the heater 600. In the description of this embodiment, the same reference numerals as in Embodiment 1 are assigned to the elements having the corresponding functions in this embodiment, and the detailed description thereof is omitted for simplicity.

As shown in FIG. 9, the heat generating element 620 of the heater 600 of this embodiment is supplied with the electric energy from the electrical contact 641 provided in the one end portion side 610*a* of the substrate and the electrical contacts 651, 661 provided in the other end portion side 610*b* of the substrate. In this other end portion side 610*b* of the substrate, the electrical contact 661 and the electrical contact 651 are arranged in the longitudinal direction of the substrate 610.

In the heater 600 of this embodiment, the opposite electroconductive lines 660*a* and 660*b* extend so as to surround the electrical contact 651. With such a structure, the opposite electroconductive lines 660*a* and 660*b* are connected to the electrical contact 661. The electrical contact 661 functions as the electrical contacts 661*a* and 661*b* of Embodiment 1.

In this embodiment, the size of the electrical contact 661 is approx. 7 mm×approx. 3 mm, and the size of the electrical contact 651 is approx. 6 mm×approx. 3 mm.

Figure 10:
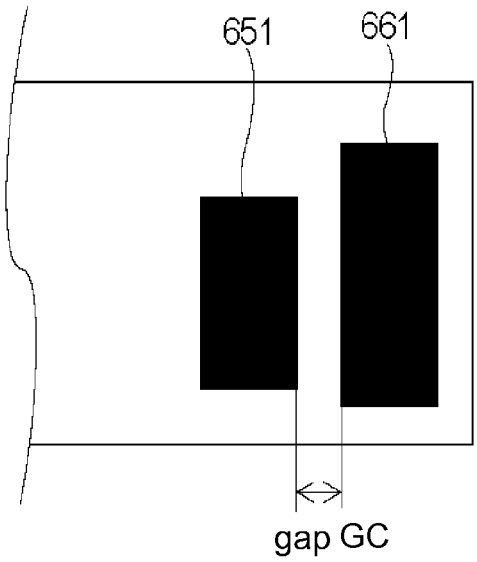
FIG. 10 illustrates an arrangement of the electrical contacts according to Embodiment 2 of the present invention.

The electrical contacts 651, 661 disposed in the other end portion side 610*b* of the substrate which are disposed adjacent to each other are connected to the same voltage source contact. Therefore, the gap GC between the electrical contacts 651 and 661 shown in FIG. 10 will suffice if insulation is provided to assure the normal operation of the heater 600, and they can be minimized. However, in consideration of the mounting tolerances of the connector 700*b* and/or the possible short circuit attributable to the thermal expansion of the substrate 610, the gap GC in this embodiment is approx. 1.5 mm. When the gap between the electrical contacts 651 and 661*b* is not constant because of non-parallelism between the electrical contacts 651 and 661*b*, a minimum value of the gap is deemed as the gap GC.

By dividing the electrical contacts connected to the different voltage source contacts into the one end portion side 610*a* of the substrate and the other end portion side 610*b*, the gap between the adjacent electrical contacts can be reduced. More specifically, the gap between the adjacent electrical contacts may be reduced to less than 4.0 mm (further preferably less than 2.5 mm). Therefore, the upsizing of the substrate in the longitudinal direction of the substrate due to the arrangement of the electrical contacts along the longitudinal direction can be suppressed. In this embodiment, the plurality of opposite electroconductive lines 660*a*, 660*b* are connected to a single electrical contact 661, and therefore, the number of the electrical contacts is smaller than that in Embodiment 1. Therefore, the length of the substrate 610 can be reduced corresponding to one electrical contact (approx. 3 mm) plus one gap (approx. 1.5 mm).

Embodiment 3

Figure 11:
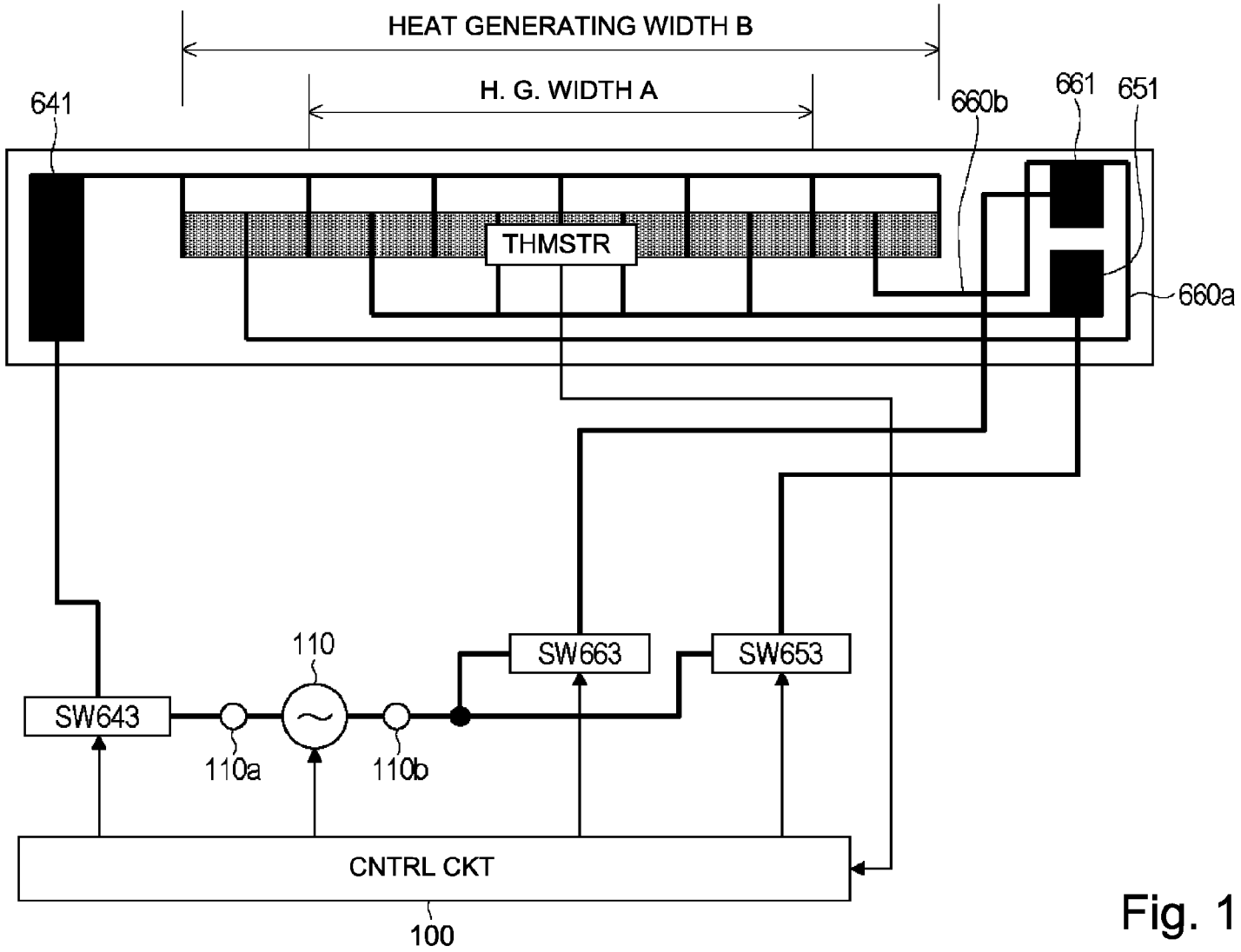
FIG. 11 illustrates the structural the relationship of the image heating apparatus according to an Embodiment 3.
Figure 12:
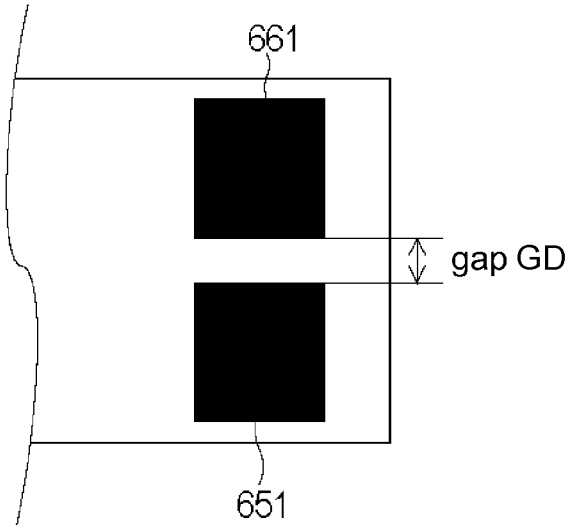
FIG. 12 illustrates an arrangement of the electrical contacts according to Embodiment 3 of the present invention.

A heater according to Embodiment 3 of the present invention will be described. FIG. 11 is an illustration of a structure relation of the image heating apparatus of this embodiment. FIG. 12 shows the arrangement of the electrical contacts in this embodiment. In Embodiment 2, the electrical contacts 651 and 661 are arranged in the longitudinal direction of the substrate in the other end portion side 610*b* of the substrate. In Embodiment 3, the electrical contacts 651 and 661 are arranged in the widthwise direction of the substrate in the other end portion side 610*b* of the substrate. With the structure of this embodiment, the length of the substrate is reduced. The details of the heater 600 of this embodiment will be described in conjunction with the drawings. The structures of the fixing device 40 of Embodiment 3 are fundamentally the same as those of Embodiment 2 except for the structures relating to the heater 600. In the description of this embodiment, the same reference numerals as in Embodiment 2 are assigned to the elements having the corresponding functions in this embodiment, and the detailed description thereof is omitted for simplicity.

As shown in FIG. 11, in the heater 600 of this embodiment, the heat generating element 620 is supplied with the electric power through the electrical contacts 641, 651, 661 provided in one end portion side of the substrate 610 with respect to the longitudinal direction. The electrical contact 661 is disposed adjacent to the electrical contact 641 with a gap therebetween, and they are arranged in the longitudinal direction of the substrate 610. The electrical contact 651 is disposed adjacent to the electrical contact 641 with a gap therebetween, and they are arranged in the longitudinal direction of the substrate 610. The electrical contact 661 disposed adjacent to the electrical contact 651 with a gap therebetween, and they are arranged in the widthwise direction of the substrate.

In the heater 600 of this embodiment, the opposite electroconductive lines 660*a* and 660*b* extend so as to surround the electrical contact 651. With such a structure, the opposite electroconductive lines 660*a* and 660*b* are connected to the electrical contact 661. The electrical contact 661 functions as the electrical contacts 661*a* and 661*b* of Embodiment 1.

In this embodiment, the size of the electrical contact 661 is approx. 7 mm×approx. 3 mm, and the size of the electrical contact 651 is approx. 6 mm×approx. 3 mm.

The electrical contacts 651, 661 disposed in the other end portion side 610*b* of the substrate which are disposed adjacent to each other are connected to the same voltage source contact. Therefore, the gap GD between the electrical contacts 651 and 661 shown in FIG. 12 will suffice if insulation is provided to assure the normal operation of the heater 600, and they can be minimized. However, in consideration of the mounting tolerances of the connector 700*b* and/or the possible short circuit attributable to the thermal expansion of the substrate 610, the gap GD in this embodiment is approx. 1.5 mm. When the gap between the electrical contacts 651 and 661 is not constant because of non-parallelism between the electrical contacts 651 and 661*b*, a minimum value of the gap is deemed as the gap GD. With such a structure, the width of the electrical contacts can be reduced. In this embodiment, the width of the electrical contacts in total in the other end portion side 610*b* of the substrate is approx. 7.5 mm, and therefore, the electrical contacts can be accommodating in the substrate 610 having the width of approx. 8 mm.

By dividing the electrical contacts connected to the different voltage source contacts into the one end portion side

610*a* of the substrate and the other end portion side 610*b*, the gap between the adjacent electrical contacts can be reduced. More specifically, the gap between the electrical contacts may be reduced to less than 4.0 mm (further preferably less than 2.5 mm). Therefore, by reducing the gap between the electrical contacts, two electrical contacts can be arranged in the widthwise direction. In other words, as compared with Embodiment 2, the number of electrical contacts arranged in the longitudinal direction of the substrate 610 is reduced by one in this embodiment. Therefore, the length of the substrate 610 can be reduced corresponding to one electrical contact (approx. 3 mm) plus one gap (approx. 1.5 mm).

The heaters per se in the foregoing embodiments can be summarized as follows:

A. A heater including an elongated substrate; a first electrode provided on the substrate adjacent to one longitudinal end of the substrate; a second electrode provided on the substrate adjacent to the other longitudinal end of the substrate and electrically isolated from the first electrode; a third electrode provided on the substrate adjacent to the other longitudinal end of the substrate and electrically isolated from the first electrode and from the second electrode; a first common electroconductive line provided on the substrate and electrically connected with the first electrode; a second common electroconductive line provided on the substrate and electrically connected with the second electrode; a third common electroconductive line provided on the substrate and electrically connected with the third electrode; a first group of electrical contacts provided on the substrate and electrically connected with the first electrode; a second group of electrical contacts provided on the substrate, the electrical contacts of the first group and the second group being arranged along a longitudinal direction of the substrate in an interlacing relationship, the second group of electrical contacts including a first sub-group of electrical contacts and a second sub-group of electrical contacts, the electrical contacts of the first sub-group being electrically connected with the second common electroconductive line, and the electrical contacts of the second sub-group being electrically connected with the third common electroconductive line; and an elongated electrically energizable heater portion provided on a surface of the substrate between the first electrode and the second electrode and electrically connected with the electrical contacts of the first group and the second group at a surface of the heater portion closer to the substrate.

B. A heater including an elongated substrate; a first electrode provided on the substrate adjacent to one longitudinal end of the substrate; a second electrode provided on the substrate adjacent to the other longitudinal end of the substrate and electrically isolated from the first electrode; a third electrode provided on the substrate adjacent to the other longitudinal end of the substrate and electrically isolated from the first electrode and from the second electrode; a first common electroconductive line provided on the substrate and electrically connected with the first electrode; a second common electroconductive line provided on the substrate and electrically connected with the second electrode; a third common electroconductive line provided on the substrate and electrically connected with the third electrode; a first group of electrical contacts provided on the substrate and electrically connected with the first electrode; a second group of electrical contacts provided on the substrate, the electrical contacts of the first group and the second group being arranged along a longitudinal direction of the substrate in an interlacing relationship, the second group of electrical contacts including a first sub-group of electrical contacts and a second sub-group of electrical contacts, the electrical contacts of the first sub-group being electrically connected with the second common electroconductive line, and the electrical contacts of the second sub-group being electrically connected with the third common electroconductive line; and an elongated electrically energizable heater portion provided on a surface of the substrate between the first electrode and the second electrode and electrically connected with the electrical contacts of the first group and the second group at a surface of the heater portion remote from to the substrate.

C. A heater including an elongated substrate; a first electrode provided on the substrate adjacent to one longitudinal end of the substrate; a second electrode provided on the substrate adjacent to the other longitudinal end of the substrate and electrically isolated from the first electrode; a third electrode provided on the substrate adjacent to the other longitudinal end of the substrate and electrically isolated from the first electrode and from the second electrode; a first common electroconductive line provided on the substrate and electrically connected with the first electrode; a second common electroconductive line provided on the substrate and electrically connected with the second electrode; a third common electroconductive line provided on the substrate and electrically connected with the third electrode; a first group of electrical contacts provided on the substrate and electrically connected with the first electrode; a second group of electrical contacts provided on the substrate, the electrical contacts of the first group and the second group being arranged along a longitudinal direction of the substrate in an interlacing relationship, the second group of electrical contacts including a first sub-group of electrical contacts and a second sub-group of electrical contacts, the electrical contacts of the first sub-group being electrically connected with the second common electroconductive line, and the electrical contacts of the second sub-group being electrically connected with the third common electroconductive line; and an elongated electrically energizable heater portion provided on a surface of the substrate between the first electrode and the second electrode, the heater portion including parts which are electrically isolated from each other and which are provided between and in contact with adjacent ones of the electrical contacts of the first and second groups at a surface of the heater portion closer to the substrate.

D. including an elongated substrate; a first electrode provided on the substrate adjacent to one longitudinal end of the substrate; a second electrode provided on the substrate adjacent to the other longitudinal end of the substrate and electrically isolated from the first electrode; a third electrode provided on the substrate adjacent to the other longitudinal end of the substrate and electrically isolated from the first electrode and from the second electrode; a first common electroconductive line provided on the substrate and electrically connected with the first electrode; a second common electroconductive line provided on the substrate and electrically connected with the second electrode; a third common electroconductive line provided on the substrate and electrically connected with the third electrode; a first group of electrical contacts provided on the substrate and electrically connected with the first electrode; a second group of electrical contacts provided on the substrate, the electrical contacts of the first group and the second group being arranged along a longitudinal direction of the substrate in an interlacing relationship, the second group of electrical contacts including a first sub-group of electrical contacts and a second sub-group of electrical contacts, the electrical contacts of the first sub-group being electrically connected with the second common electroconductive line, and the electrical contacts of the second sub-group being electrically connected with the third common electroconductive line; and an elongated electrically energizable heater portion provided on a surface of the substrate between the first electrode and the second electrode, the heater portion including parts which are electrically isolated from each other and which are provided between and in contact with adjacent ones of the electrical contacts of the first and second groups at a surface of the heater portion remote to the substrate.

Other Embodiments

The present invention is not restricted to the specific dimensions in the foregoing embodiments. The dimensions may be changed properly by one skilled in the art depending on the situations. The embodiments may be modified in the concept of the present invention.

The heat generating region of the heater 600 is not limited to the above-described examples which are based on the sheets which are supplied with the center thereof aligned with the center of the fixing device. Alternatively, the heat generating regions of the heater 600 may be modified so as to meet the case in which the sheets are supplied with one end thereof aligned with an end of the fixing device. More particularly, the heat generating elements corresponding to the heat generating region A are not heat generating elements 620*c*-620*j* but are heat generating elements 620*a*-620*e*. With such an arrangement, when the heat generating region is switched from that for a small size sheet to that for a large size sheet, the heat generating region does not expand at both of the opposite end portions. The heat generating region in the one end portion side may be enlarged.

The number of patterns of the heat generating region of the heater 600 is not limited to two. For example, three or more patterns may be provided.

The number of the electrical contacts is not limited to three or four. Five or more electrical contacts may be provided if the electrical contact connected to the voltage source contact 110*a* is disposed in one end portion side 610*a* of the substrate, and the electrical contact connected to the voltage source contact 110*b* is disposed in the other end portion side 610*b* of the substrate. For example, in Embodiment 1, in one end portion side 610*a* of the substrate, an electrical contact which is connected to the voltage source contact 110*a* and which is different from the electrical contact 641 may be provided. Similarly, in Embodiment 1, in the other end portion side 610*b* of the substrate, an electrical contact which is connected to the voltage source contact 110*b* and which is different from the electrical contact 651, 661*a*, 661*b* may be provided.

The forming method of the heat generating element 620 is not limited to those disclosed in Embodiments 1, 2. In Embodiment 1, the common electrode 642 and the opposite electrodes 652, 662 are laminated on the heat generating element 620 extending in the longitudinal direction of the substrate 610. However, the electrodes are formed in the form of an array extending in the longitudinal direction of the substrate 610, and the heat generating elements 620*a*-620*l* may be formed between the adjacent electrodes.

The belt 603 is not limited to that supported by the heater 600 at the inner surface thereof and driven by the roller 70. For example, a so-called belt unit type in which the belt is extended around a plurality of rollers and is driven by one of the rollers may be used. However, the structures of Embodiments 1-4 are preferable from the standpoint of low thermal capacity.

The member cooperative with the belt 603 to form of the nip N is not limited to the roller member such as a roller 70. For example, it may be a so-called pressing belt unit including a belt extended around a plurality of rollers.

The image forming apparatus which has been a printer 1 is not limited to that capable of forming a full-color, but it may be a monochromatic image forming apparatus. The image forming apparatus may be a copying machine, a facsimile machine, a multifunction machine having the function of them, or the like, for example.

The image heating apparatus is not limited to the apparatus for fixing a toner image on a sheet P. It may be a device for fixing a semi-fixed toner image into a completely fixed image, or a device for heating an already fixed image. Therefore, the fixing device 40 as the image heating apparatus may be a surface heating apparatus for adjusting a glossiness and/or surface property of the image, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-108592 filed on May 26, 2014, which is hereby incorporated by reference herein in its entirety.

What is claimed is:

1. A heater usable with an image heating apparatus including an electric energy supplying portion provided with a first terminal and a second terminal, and an endless belt for heating an image on a sheet, wherein said heater is contactable to the belt to heat the belt, said heater comprising:

a substrate;

a plurality of contact portions including at least a first contact portion provided on said substrate and electrically connectable with the first terminal, and a plurality of second contact portions provided on said substrate and electrically connectable with the second terminal;

a plurality of electrode portions arranged in a longitudinal direction of said substrate with predetermined gaps therebetween;

a plurality of electroconductive line portions electrically connecting said electrode portions with respective ones of said contact portions, such that an electrode portion electrically connected with said at least one first contact portion and another electrode portion electrically connected with said second contact portions are alternately arranged in the longitudinal direction of said substrate; and a plurality of heat generating portions, provided between adjacent electrode portions, respectively, for generating heat by electric power supply between adjacent electrode portions, wherein all of said first contact portions are provided in one end portion side of said substrate with respect to the longitudinal direction, and all of said second contact portions are provided in another end portion side of said substrate with respect to the longitudinal direction, wherein said electroconductive line portions include:

a first electroconductive line portion electrically connecting a first heat generating portion of said heat generating portions with said at least one contact portion, a second electroconductive line portion electrically connecting a second heat generating portion of said heat generating portions, which is different from said first heat generating portion, with one of said second contact portions, a third electroconductive line portion electrically connecting said first heat generating portion with a predetermined contact portion of said second contact portions, and a fourth electroconductive line portion electrically connecting said second heat generating portion with the predetermined contact portion, wherein said first electroconductive line portion is longer than said second electroconductive line portion, and said fourth electroconductive line portion is longer than said third electroconductive line portion.

2. A heater usable with an image heating apparatus including an electric energy supplying portion provided with a first terminal and a second terminal, and an endless belt for heating an image on a sheet, wherein said heater is contactable to the belt to heat the belt, said heater comprising:

a substrate;

a plurality of contact portions including at least a first contact portion provided on said substrate and electrically connectable with the first terminal, and a plurality of second contact portions provided on said substrate and electrically connectable with the second terminal;

a plurality of electrode portions arranged in a longitudinal direction of said substrate with predetermined gaps therebetween;

a plurality of electroconductive line portions electrically connecting said electrode portions with respective ones of said contact portions, such that an electrode portion electrically connected with said at least one first contact portion and another electrode portion electrically connected with said second contact portions are alternately arranged in the longitudinal direction of said substrate; and a plurality of heat generating portions, provided between adjacent electrode portions, respectively, for generating heat by electric power supply between adjacent electrode portions, wherein all of said first contact portions are provided in one end portion side of said substrate with respect to the longitudinal direction, and all of said second contact portions are provided in another end portion side of said substrate with respect to the longitudinal direction, wherein said heat generating portions include a first heat generating portion, a second heat generating portion disposed closer to a longitudinal end portion of said heater than said first heat generating portion, and a third heat generating portion disposed closer to another longitudinal end portion of said heater than said first heat generating portion, wherein said second contact portions include a first second contact portion electrically connected with said first heat generating portion, and a second second contact portion electrically connected with said second heat generating portion and with said third heat generating portion.

3. An image heating apparatus comprising:

an electric energy supplying portion provided with a first terminal and a second terminal;

an endless belt for heating an image on a sheet;

a substrate provided inside said belt and extending in a widthwise direction of said belt;

a plurality of contact portions including at least a first contact portion provided on said substrate and electrically connectable with the first terminal, and a plurality of second contact portions provided on said substrate and electrically connectable with the second terminal;

a plurality of electrode portions arranged in a longitudinal direction of said substrate with predetermined gaps therebetween;

a plurality of electroconductive line portions electrically connecting said electrode portions with respective ones of said contact portions, such that an electrode portion electrically connected with said at least one first contact portion and another electrode portion electrically connected with said second contact portions are alternately arranged in the longitudinal direction of said substrate; and a plurality of heat generating portions, provided between adjacent electrode portions, respectively, for generating heat by electric power supply between adjacent electrode portions, wherein, when a sheet having a maximum width usable with said apparatus is heated, said electric energy supplying portion supplies electric energy to all of said heat generating portions through said at least one first contact portion and all of said second contact portions so that all of said heat generating portions generate heat, and wherein when a sheet having a width smaller than the maximum width is heated, said electric energy supplying portion supplies electric energy to said first heat generating portion and to a part of said second heat generating portions through said at least one first contact portion and a part of said second contact portions so that a part of said heat generating portions generates heat, wherein all of said first contact portions are provided in an end portion side of said substrate with respect to the longitudinal direction, and all of said second contact portions are provided in another end portion side of said substrate with respect to the longitudinal direction, wherein said electroconductive line portions include:

a first electroconductive line portion electrically connecting a first heat generating portion of said heat generating portions with said at least one first contact portion, a second electroconductive line portion electrically connecting a second heat generating portion of said heat generating portions, which is different from said first heat generating portion, with one of said second contact portions, a third electroconductive line portion electrically connecting said first heat generating portion with a predetermined contact portion of said second contact portions, and a fourth electroconductive line portion electrically connecting said second heat generating portion with the predetermined contact portion, wherein said first electroconductive line portion is longer than said second electroconductive line portion, and said fourth electroconductive line portion is longer than said third electroconductive line portion.

4. An image heating apparatus comprising:

an electric energy supplying portion provided with a first terminal and a second terminal;

an endless belt for heating an image on a sheet;

a substrate provided inside said belt and extending in a widthwise direction of said belt;

a plurality of contact portions including at least a first contact portion provided on said substrate and electrically connectable with the first terminal, and a plurality of second contact portions provided on said substrate and electrically connectable with the second terminal;

a plurality of electrode portions arranged in a longitudinal direction of said substrate with predetermined gaps therebetween;

a plurality of electroconductive line portions electrically connecting said electrode portions with respective ones of said contact portions, such that an electrode portion electrically connected with said at least one first contact portion and another electrode portion electrically connected with said second contact portions are alternately arranged in the longitudinal direction of said substrate; and a plurality of heat generating portions, provided between adjacent electrode portions, respectively, for generating heat by electric power supply between adjacent electrode portions, wherein, when a sheet having a maximum width usable with said apparatus is heated, said electric energy supplying portion supplies electric energy to all of said heat generating portions through said at least one first contact portion and all of said second contact portions so that all of said heat generating portions generate heat, and wherein when a sheet having a width smaller than the maximum width is heated, said electric energy supplying portion supplies electric energy to said first heat generating portion and to a part of said second heat generating portions through said at least one first contact portion and a part of said second contact portions so that a part of said heat generating portions generates heat, wherein all of said first contact portions are provided in an end portion side of said substrate with respect to the longitudinal direction, and all of said second contact portions are provided in another end portion side of said substrate with respect to the longitudinal direction, wherein said heat generating portions include a first heat generating portion, a second heat generating portion disposed closer to a longitudinal end portion of said heater than said first heat generating portion, and a third heat generating portion disposed closer to another longitudinal end portion of said heater than said first heat generating portion, wherein said second contact portions include a first second contact portion electrically connected with said first heat generating portion, and a second second contact portion electrically connected with said second heat generating portion and with said third heat generating portion.

5. A heater connectable with an electric power supply portion having a first terminal and a second terminal, said heater comprising:

an elongate substrate;

a first electric contact provided on said substrate and electrically connectable with the first terminal;

a plurality of second electric contacts provided on said substrate and electrically connectable with the second terminal;

a first electroconductive line extended in a longitudinal direction of said substrate and electrically connected with said first electric contact;

a plurality of second electroconductive lines extended in a longitudinal direction of said substrate and electrically connected with one of said second electric contacts;

a plurality of electrodes including first electrodes electrically connected with said first electric contact through said first electroconductive line, and second electrodes electrically connected with one of said second electric contacts, through one of said second electroconductive lines, said first electrodes and said second electrodes being arranged alternately with predetermined gaps therebetween in the longitudinal direction; and a plurality of heat generating portions provided between adjacent ones of said electrodes so as to provide an electrical connection between adjacent electrodes and allow flow of current between adjacent electrodes in the longitudinal direction, said heat generating portions being capable of generating heat by flowing of the current between adjacent electrodes, wherein said first electrical contact is disposed at an area closer to a longitudinal end of said substrate than said heat generating portions, and all of said second electrical contacts are disposed at an area closer to another longitudinal end of said substrate than said heat generating portions.

6. A heater according to claim 5, wherein said first electroconductive line is disposed at an area closer to one end of said substrate than said heat generating portions in a widthwise direction perpendicular to the longitudinal direction, and all of said second electroconductive lines are disposed at an area closer to another end of said substrate than said heat generating portions in the widthwise direction.

7. A heater according to claim 5, wherein a gap between adjacent ones of said second electric contacts is shorter than a gap between said first electric contact and a closest one of said heat generating portions in the longitudinal direction.

8. A heater according to claim 7, wherein the gap between adjacent ones of said second electric contacts in the longitudinal direction is less than 2.5 mm.

9. A heater according to claim 5, wherein a first heat generating area using said first electrode and all of said second electrodes is wider than a second heat generating area using said first electrode and one of said second electrodes.

10. A heater according to claim 9, wherein the first heat generating area and the second heat generating area overlap.

11. An image heating apparatus comprising:

an electric energy supplying portion provided with a first terminal and a second terminal;

a rotatable member configured to heat an image on a sheet; and a heater configured to heat said rotatable member, said heater including:

an elongate substrate;

a first electric contact provided on said substrate and electrically connectable with the first terminal;

a plurality of second electric contacts provided on said substrate and electrically connectable with the second terminal;

a first electroconductive line extended in a longitudinal direction of said substrate and electrically connected with said first electric contact;

a plurality of second electroconductive lines extended in a longitudinal direction of said substrate and electrically connected with one of said second electric contacts;

a plurality of electrodes including first electrodes electrically connected with said first electric contact through said first electroconductive line, and second electrodes electrically connected with one of said second electric contacts, through one of said second electroconductive lines, said first electrodes and said second electrodes being arranged alternately with predetermined gaps therebetween in the longitudinal direction; and a plurality of heat generating portions provided between adjacent ones of said electrodes so as to provide an electrical connection between adjacent electrodes and allow flow of current between adjacent electrodes in the longitudinal direction, said heat generating portions being capable of generating heat by flowing of the current between adjacent electrodes, wherein said first electrical contact is disposed at an area closer to a longitudinal end of said substrate than said heat generating portions, and all of said second electrical contacts are disposed at an area closer to another longitudinal end of said substrate than said heat generating portions.

12. An apparatus according to claim 11, wherein said first electroconductive line is disposed at an area closer to one end of said substrate than said heat generating portions in a widthwise direction perpendicular to the longitudinal direction, and all of said second electroconductive lines are disposed at an area closer to another end of said substrate than said heat generating portions in the widthwise direction.

13. An apparatus according to claim 11, wherein a gap between adjacent ones of said second electric contacts is shorter than a gap between said first electric contact and a closest one of said heat generating portions in the longitudinal direction.

14. An apparatus according to claim 13, wherein the gap between adjacent ones of said second electric contacts in the longitudinal direction is less than 2.5 mm.

15. An apparatus according to claim 11, wherein a first heat generating area using said first electrode and all of said second electrodes is wider than a second heat generating area using said first electrode and one of said second electrodes.

16. An apparatus according to claim 15, wherein the first heat generating area and the second heat generating area overlap.

* * * * *